US008172435B2

(12) United States Patent
Spiro et al.

(10) Patent No.: US 8,172,435 B2
(45) Date of Patent: May 8, 2012

(54) METHODS AND APPARATUS FOR CEILING MOUNTED SYSTEMS

(75) Inventors: Daniel S. Spiro, Paradise Valley, AZ (US); Leland R. Whitney, St. Paul, MN (US)

(73) Assignee: Exposure Illumination Architects, Inc., Scottsdale, AZ (US)

( * ) Notice: Subject to any disclaimer, the term of this patent is extended or adjusted under 35 U.S.C. 154(b) by 0 days.

(21) Appl. No.: 12/881,095

(22) Filed: Sep. 13, 2010

(65) Prior Publication Data

US 2011/0068711 A1 Mar. 24, 2011

Related U.S. Application Data

(60) Provisional application No. 61/301,846, filed on Feb. 5, 2010, provisional application No. 61/295,264, filed on Jan. 15, 2010, provisional application No. 61/241,484, filed on Sep. 11, 2009.

(51) Int. Cl.
*F21V 21/00* (2006.01)

(52) U.S. Cl. ..... 362/391; 362/147; 362/294; 362/404

(58) Field of Classification Search ..... 362/147, 362/294, 311.02, 311.03, 311.05, 327, 373, 362/391, 404; 439/110
See application file for complete search history.

(56) References Cited

U.S. PATENT DOCUMENTS

| | | | | |
|---|---|---|---|---|
| 5,188,449 | A * | 2/1993 | Davis et al. | 362/404 |
| 5,672,003 | A * | 9/1997 | Shemitz et al. | 362/404 |
| 6,739,740 | B1 * | 5/2004 | Feldman | 362/404 |
| 7,172,332 | B2 * | 2/2007 | Mobarak et al. | 362/391 |
| 7,726,869 | B2 * | 6/2010 | Chien | 362/294 |
| 7,972,054 | B2 * | 7/2011 | Alexander et al. | 362/147 |
| 2003/0179578 | A1 * | 9/2003 | Albert et al. | 362/276 |
| 2006/0262521 | A1 * | 11/2006 | Piepgras et al. | 362/404 |
| 2007/0058377 | A1 | 3/2007 | Zampini, II et al. | |
| 2008/0061668 | A1 | 3/2008 | Spiro | |
| 2008/0158878 | A1 | 7/2008 | Van Laanen et al. | |
| 2009/0211130 | A1 | 8/2009 | Hoffman et al. | |
| 2009/0295292 | A1 * | 12/2009 | Harmgardt et al. | 362/294 |

FOREIGN PATENT DOCUMENTS

WO 03038348 A1 5/2003

* cited by examiner

*Primary Examiner* — Y My Quach Lee

(74) *Attorney, Agent, or Firm* — The Noblitt Group, PLLC

(57) ABSTRACT

Methods and apparatus for ceiling suspended systems according to various aspects of the present invention include a modular platform for supporting and supplying multiple devices. A wire way bar may facilitate connection and support for the devices, such as light sources and other systems.

20 Claims, 24 Drawing Sheets

| BrightPort Device Functionality & Discipline Integrator | | | | | | | | | | | | | | | | | | | | | |
|---|---|---|---|---|---|---|---|---|---|---|---|---|---|---|---|---|---|---|---|---|---|
| | Integrated Function | | | | | | | | | | | | | | | | Interfaced Function | | | | |
| Devices | Lighting Ambient | Emergency Lighting | Daylighting Harvesting | Lighting Energy Management | Public Announcement | Music | Noise Cancellation | Alarming - Burglar | Alarming - Fire | Surveillance Operational | Surveillance - Theft | Surveillance - Emergency | Wireless Hot Spot | RF | | Maintenance | HVAC | Fire Dept | Police | Tampering Alert | Server Operational Log |
| Torchiere | o | o | o | o | | | | | | | o | | | | | o | | | | | o |
| Speaker | | o | | | o | o | o | o | o | | | | | | | o | | | | o | o |
| Camera | | o | | | | | | o | o | o | o | o | | | | o | | o | o | o | o |
| Antenna | | | | | | | | | | | | | o | o | | o | | | | | o |
| Photo Sensor | | | o | | | | | | | | | | | | | o | o | | | | o |
| Occupancy Sensor | o | | o | o | | | | | o | | o | o | | | | o | o | | o | o | o |
| Air Quality Sensor | | | | | | | | | | | | | | | | o | | o | | | o |
| Thermal Sensor | | | | | | | | | | | | | | | | o | o | | | | o |
| Smoke Sensor | | o | | | | | | | o | | | o | | | | o | | o | | | o |
| Humidity Sensor | | | | | | | | | | | | | | | | o | o | | | | o |
| | | | | | | | | | | | | | | | | | | | | | |
| | | | | | | | | | | | | | | | | | | | | | |

FIGURE 23

BrightPort – Device Connectivity

BrightPort I

Section Length: 2, 4, 8 & 12 ft

Typical Section: 8 ft

Port Functionality

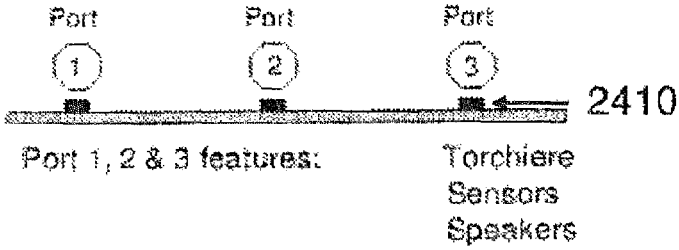

Power – (4ea) 14Ga 24V power line

Communicative & control – 2ea twisted pairs RS-485

FIGURE 24A

BrightPort II

Section Length: 2, 4, 8 & 12 ft

Typical Section: 8 ft

Port Functionality

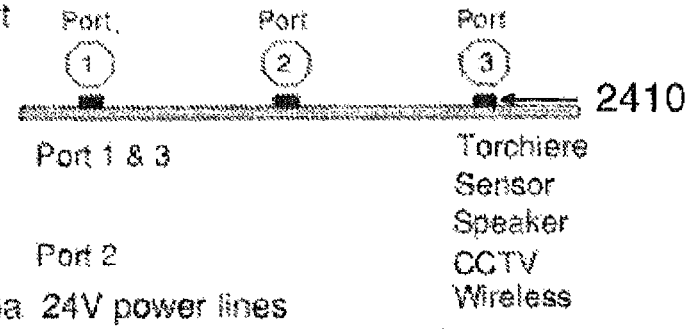

Power – (4)ea 14Ga 24V power lines

Communicative & control – 2ea twisted pairs RS-485

Video – 75 Ohm coax cable w/digital synchronization

Video command and control 2ea twisted pair RS-485

FIGURE 24B

COMMAND & CONTROL & VIDEO GATEWAY
BLOCK DIAGRAM

METHODS AND APPARATUS FOR CEILING MOUNTED SYSTEMS

CROSS-REFERENCES TO RELATED APPLICATIONS

This application claims the benefit of U.S. Provisional Patent Application No. 61/241,484, filed Sep. 11, 2009, U.S. Provisional Patent Application No. 61/295,264, filed Jan. 15, 2010, and U.S. Provisional Patent Application No. 61/301,846, filed Feb. 5, 2010, and incorporates the disclosure of each application by reference.

BACKGROUND OF THE INVENTION

Most indoor commercial spaces, such as offices, use incandescent, halogen, or fluorescent technology to provide light. These technologies can be used to illuminate many types of areas including employee workspaces, common use areas, and parking garages. However, the use of these technologies is increasingly counterproductive due to limitations such as energy inefficiency, high front end cost, maintenance costs, poor light quality, and negative environmental impact.

Commercial office space frequently utilizes fluorescent technology, which requires significant expenditures for the costs of material, maintenance, and energy consumption. This technology utilizes fluorescent lamps and ballasts attached to luminaires recessed into the ceiling plenum. Typically, fluorescent technology includes large and heavy structures, which require additional secondary support mechanisms for their installation. Replacement of fluorescent lights also generates additional cost due to mercury and other materials within the lamp. Consequently, fluorescent lights often must be disposed of as hazardous waste.

Fluorescent technology generally consumes high levels of energy and is a significant source of costs in operating a commercial office building. A portion of the energy consumed by fluorescent lamps is dissipated as heat, thus increasing the building's mechanical load. Costs associated with removal of the heat generated by fluorescent lamps include initial front end cost, such as upsizing the HVAC units, subsequent operational costs resulting from higher energy consumption, and increased maintenance costs. Although improvements in fluorescent technology such as the development of lower wattage lamps with improved electrodes and coatings as well as more efficient electronic ballasts have reduced, but not eliminated, the amount of heat dissipated by such systems, these improvements have not solved problems with visual comfort and energy inefficiency.

The lighting industry has addressed the problems of energy consumption and visual discomfort due to the fluorescent lighting glare in three ways. Replacement of fluorescent lamps with lower wattage lamps, removal of lamps in a process called de-tamping, and developing secondary optical reflectors to reduce glare. However, fluorescent lamps with series wired ballasts cannot function with fewer lamps than intended, making delamping infeasible which requires additional expenditures for retrofitting. Engineered reflective surfaces surrounding the lamp have been utilized to increase luminaire efficiency at the workplane and to control visual comfort. Second, indirect fluorescent lighting fixtures have been introduced such that the lamp does not directly face workers under the fixtures. While such indirect lighting fixtures are generally pleasant, the design of the indirect fluorescent luminaires optics often does not account for the ceiling reflective properties, thus delivering reduced light levels at the work surface.

BRIEF DESCRIPTION OF THE DRAWING

A more complete understanding of the present invention may be derived by referring to the detailed description when considered in connection with the following illustrative figures. In the following figures, like reference numbers refer to similar elements and steps throughout the figures.

FIG. 23 is a functionality chart for various devices;

FIGS. 24A-B illustrate port configurations for a wire way bar;

Figure 1:
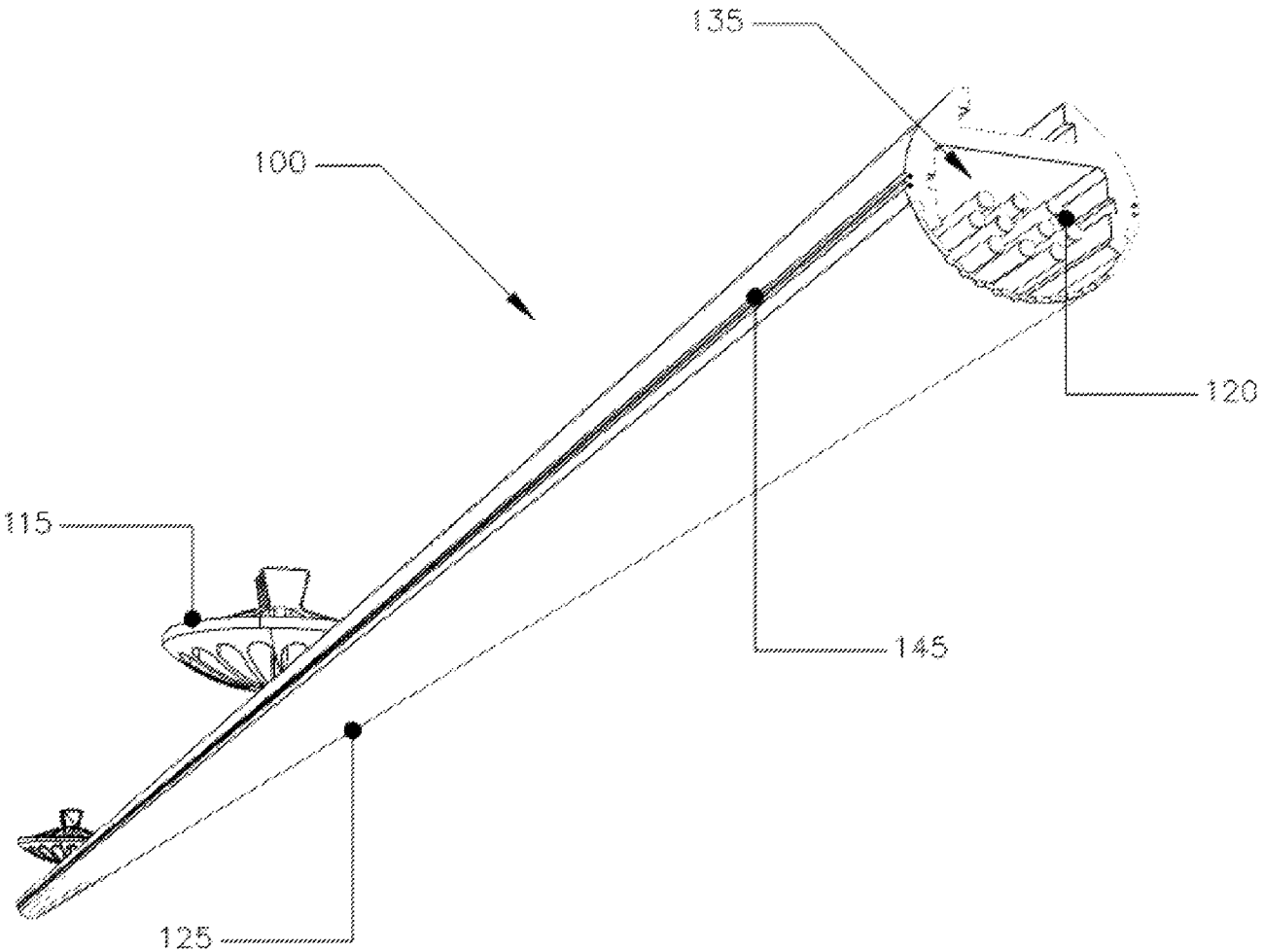
FIGS. 1 and 2 representatively illustrate a light source and a wire way bar according to various aspects of the present invention.

Elements and steps in the figures are illustrated for simplicity and clarity and have not necessarily been rendered according to any particular sequence or scale. For example, steps that may be performed concurrently or in different order are illustrated in the figures to help to improve understanding of embodiments of the present invention.

DETAILED DESCRIPTION OF EXEMPLARY EMBODIMENTS

The present invention may be described in terms of functional block components and various processing steps. Such functional blocks may be realized by any number of components configured to perform the specified functions and achieve the various results. For example, the present invention may employ various process steps, apparatus, systems, methods, etc. In addition, the present invention may be practiced in conjunction with any number of systems and methods for providing ceiling suspended systems, and the system described is merely one exemplary application for the invention. Further, the present invention may employ any number of conventional techniques for installing, controlling, enhancing, retrofitting, monitoring, updating, and/or replacing ceiling suspended systems.

The particular implementations shown and described are illustrative of the invention and its best mode and are not intended to otherwise limit the scope of the present invention in any way. For the sake of brevity, conventional manufacturing, connection, preparation, and other functional aspects of the system may not be described in detail. Furthermore, the connecting lines shown in the various figures are intended to represent exemplary functional relationships and/or steps between the various elements. Many alternative or additional functional relationships or physical connections may be present in a practical system.

Various representative implementations of the present invention may be applied to any ceiling suspended systems and other systems, such as wall mounted systems. Certain representative implementations may include, for example, systems or methods for providing light in indoor, outdoor, commercial, and/or residential areas. In an exemplary embodiment, a ceiling suspended lighting system according to various aspects of the present invention may include a light source, such as a lamp including a light emitting diode, configured as part of a modular system. The modular system may be connected mechanically and/or electrically to at least one other modular system. The modular system may be mounted to any suitable surface, such as a ceiling and/or a wall. Certain representative implementations may also include other components in addition to or instead of the light sources, such as environmental sensors like motion sensors or photocell sensors for controlling the use and/or the intensity of the light, components for a surveillance system, speakers, cameras, antennas, air quality sensors, thermal sensors, smoke sensors, humidity sensors, and other components that may be deployed near the ceiling or walls.

The modular system facilitates consolidation of multiple devices on a single platform, which tends to save time and cost of installation and operation. System integration on a single ceiling suspended platform is functional, economical, and architecturally pleasing. The modular platform may provide a power and communication wire way that at least partially integrates lighting, sound, security, fire protection, surveillance, data, and communication and environmental control devices on one platform.

In addition, the modular system may optimize system efficiency for all devices, enhance functionality by enabling system cross-communication, enhance interior operational environment through better illumination, sound quality, noise control, security and safety device integration, air quality control, etc. The modular system may offer ease of design, reconfiguration, and maintenance, and reduce cost of ownership, construction, operation, and maintenance. Further benefits may include reducing construction costs through limiting the number of trades on the job, accelerating construction progress, and reducing installation errors; reducing energy and resource usage through integrating multiple devices in one platform; reducing manufacturing, shipping and transportation costs by scaling down the product and cutting energy costs by deploying lighting and other capabilities in an efficient manner; reducing maintenance costs through using long-life self-reporting devices which enable smart servicing schedules; and offering through a single point of contact engineering assessment, system design consulting, product procurement, shipping logistics, system commissioning, technical support and long term customer care.

Figure 2:
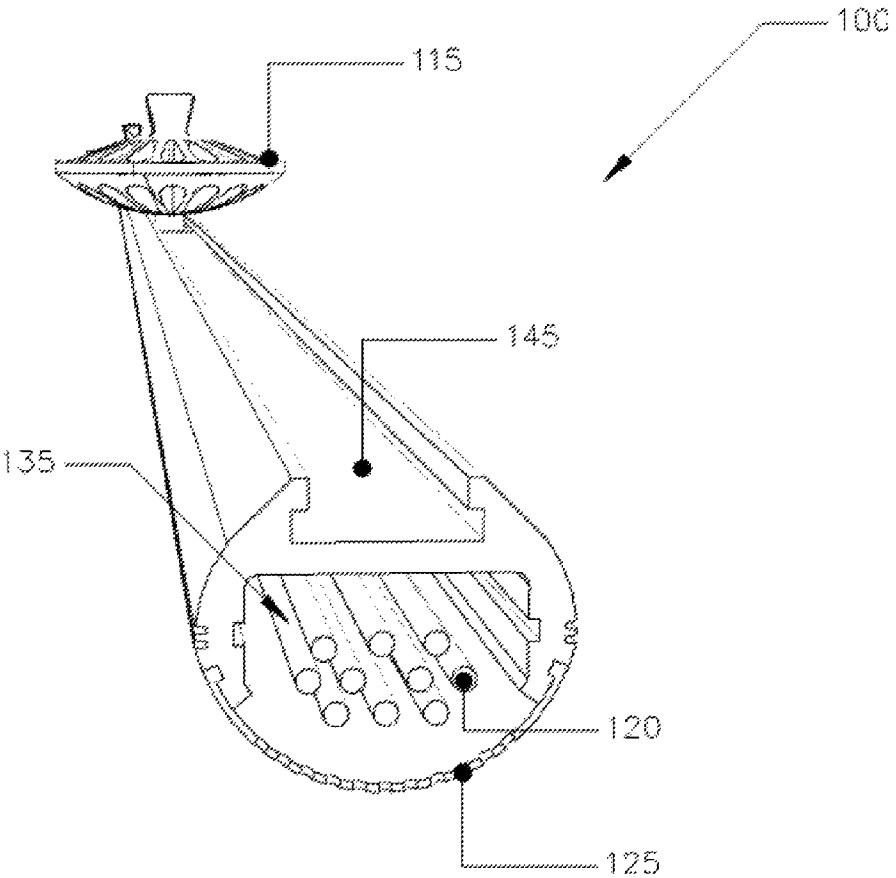

Referring now to FIGS. 1-2, systems and methods for ceiling suspended or wall mounted systems according to various aspects of the present invention may be representatively illustrated by a ceiling suspended lighting system 100. For example, the lighting system 100 may comprise a light source, such as a light-emitting diode (LED) unit 115, and a wire way bar 145. The LED unit 115 provides illumination and receives power via the wire way bar 145. Any appropriate elements may be connected to and powered by the wire way bar 145, however, such as other types of light sources, sensors, transmitters, control systems, speakers, cameras, or other components.

The light source may comprise any suitable light-generating system adapted to receive power from the wire way bar 145 and generate light, such as conventional incandescent and fluorescent lights. The light source may be a basic solid state light that lights up when power is applied and shuts down when power is disconnected. It may comprise an input voltage conversion unit that accepts any AC or DC voltage and converts the input into a DC voltage that powers the solid state light. It may also comprise a current source and a solid state high power light.

The light source may be extended, but also be very small compared to the ultimate target size and distance to the target. The light source may be Lambertian or nearly Lambertian. There may be visual wavelengths. The light source may be horizontal, and the light sources may be distributed in a horizontal plane. The multiple sources may be distributed in a regular array, which may be a rectangular array.

The target of the light source may be a horizontal plane, at a limited distance above the light source, such as 1 to 3 feet. The light source may uniformly distribute light on the ceiling (roughly max/min<=2), and it may achieve roughly 94% efficiency. The regular array of Lambertian source may irradiate the ceiling with a corresponding regular array of very bright spots.

In one embodiment, the light source comprises the LED unit 115 and includes an LED lamp 105, a lens 505, and a heat sink 110. The lens 505 directs light from the LED lamp 105 in desired directions, while the heat sink dissipates heat generated by the LED lamp 105. The light source may comprise, however, any appropriate light source and related elements, such as bulbs, cooling systems, reflectors, diffusers, and connectors.

In the present embodiment, the LED lamp 105 may comprise any suitable LED or combination of LEDs, such as a red-green-blue LED system and/or a phosphor-converted LED. In one embodiment, the LED lamp 105 may comprise multiple LEDs that may be configured to be flat, a cluster, and/or a bulb. The LED lamp 105 may be configured to emit white light, colored light, or combinations of different frequencies, intensities, or polarizations. In one exemplary embodiment, the LEDs may comprise gallium-based crystals such as gallium nitride, indium gallium nitride, and/or gallium aluminum phosphide. The LEDs may further comprise an additional material, such as phosphorus, to produce white light. For example, a phosphor material may convert monochromic light from a blue or UV LED to broad-spectrum white light. The LED lamp 105 may comprise, however, any suitable LED system.

Figure 10:
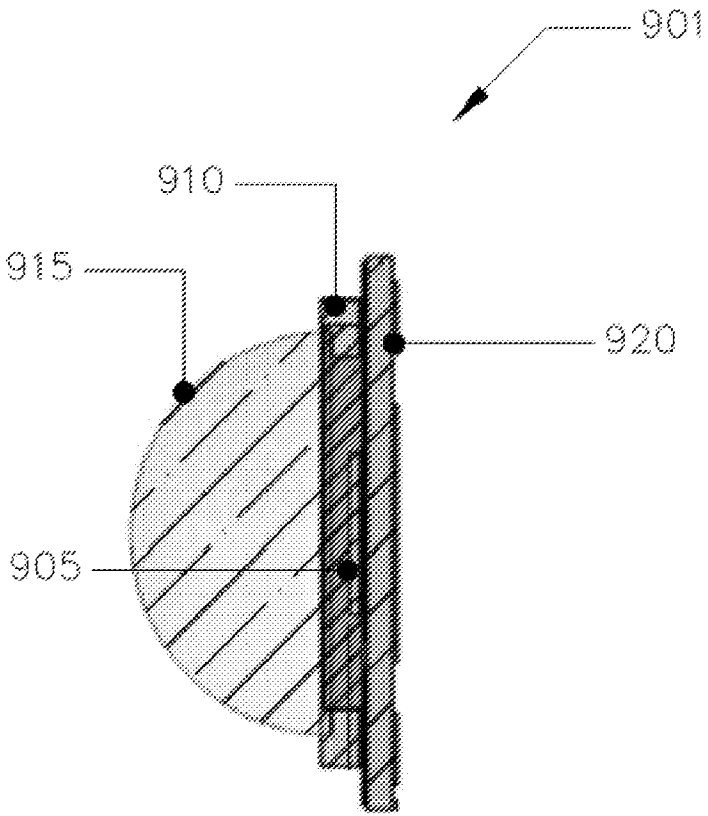
FIG. 10 representatively illustrates a cross-sectional view of the LED lamp.
Figure 9:
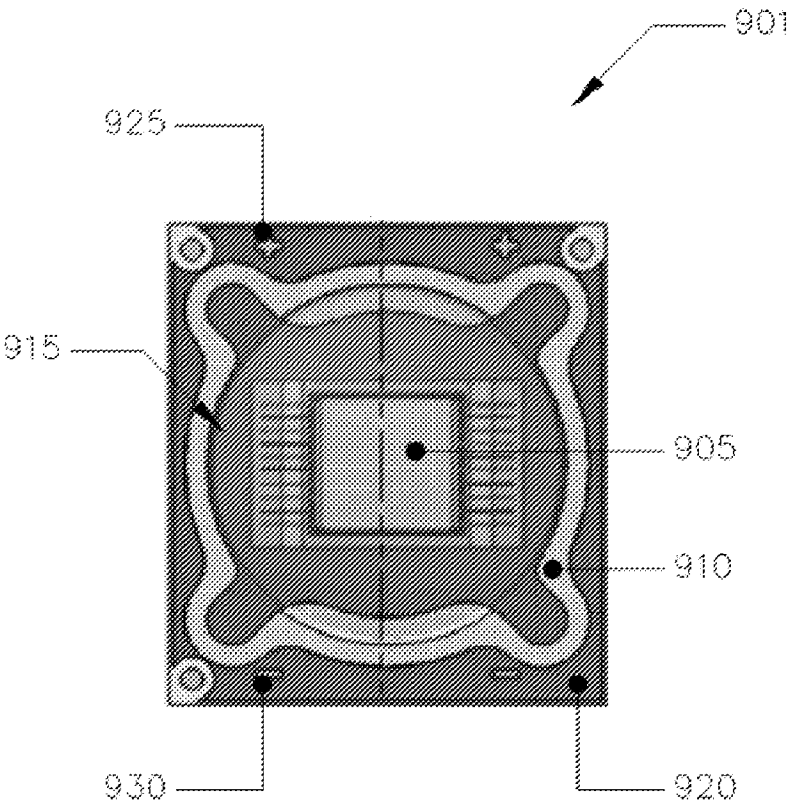
FIG. 9 representatively illustrates a top view of an LED lamp.
Figure 12:
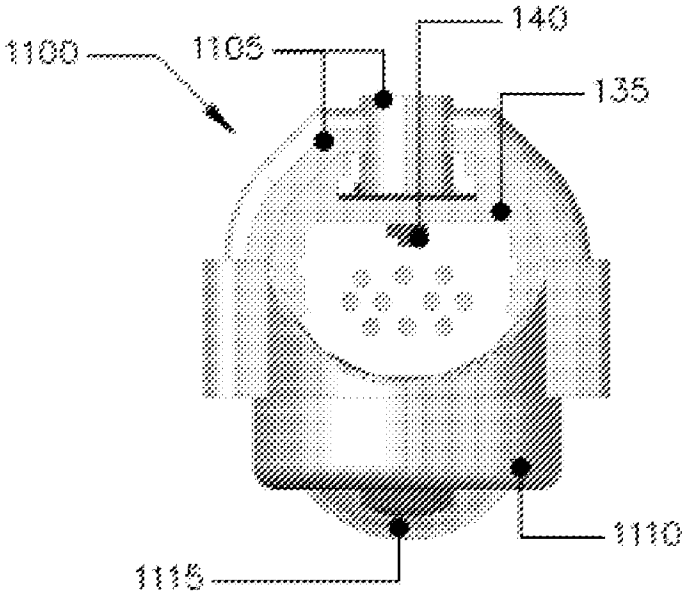
FIG. 12 representatively illustrates a cross-sectional view of the wire way bar and the occupancy sensor in accordance with an exemplary embodiment of the present invention.
Figure 11:
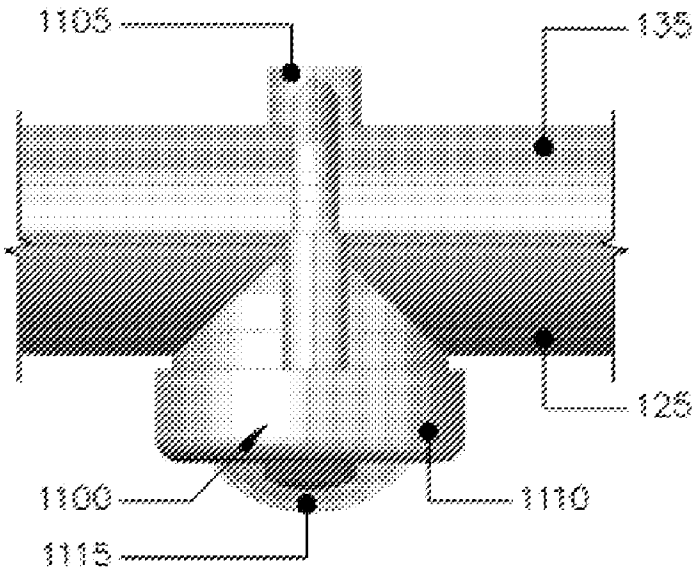
FIG. 11 representatively illustrates the wire way bar and an occupancy sensor in accordance with an exemplary embodiment of the present invention.

Referring to FIGS. 9 and 10, an exemplary LED lamp 105 may include a conventional LED subassembly 901 comprising at least one of an LED 905, a substrate 920, and a diffuser 915. The substrate 920 may comprise any appropriate substrate, such as sapphire, silicon carbide, silicon, and combinations of such materials. The substrate 920 may comprise a thermally conductive material to dissipate heat generated by the LED 905. The diffuser 915 may substantially cover the LED 905 and comprise any suitable material that allows diffuse transmission of light emitted by the LED 905. In one embodiment, the diffuser 915 may comprise a polycarbonate material. In another embodiment, the diffuser 915 may be configured to protect the LED components 905 from damage from the environment such as dust and/or moisture and/or guard the components 905 from electrostatic discharge creating a seal with a frame 910. In other embodiments, the diffuser 915 may be omitted or replaced by other components, such as a lens.

The LED subassembly 901 may further comprise at least one positive electrode 925 and at least one negative electrode 930 coupled to the LED 905. The positive electrode 925 and the negative electrode 930 may be coupled to at least one of power and a control circuit, providing power to and/or control of the LED 905. In one aspect of the embodiment, the frame 910 may be coupled to the diffuser 915 and the LED subassembly 901 to secure the position of the diffuser 915 over the LED 905. The frame 910 may be attached to the heat sink 110, for example to transfer heat from the LED 905 and diffuser 915 to the heat sink 110.

The LED subassembly 901 may be adapted or selected according to any appropriate criteria. For example, the LED subassembly 901 may comprise a high efficiency and high output LED package. The LED subassembly 901 may be selected for high thermal conductivity, reliability, and long operating lifetime. In one embodiment, the LED subassembly 901 comprises a monolithic, encapsulated, lensed, surface mountable package, such as an SST-90-W Series LED from Luminus Devices, Inc. The LED lamp 105 may comprise multiple LED subassemblies 901; such as a rectangular array of multiple packages.

The lens 505 may comprise any appropriate system for directing light, such as a refractive, reflective, and/or diffusive system. The lens 505 may direct light from the LED lamp 105 in any suitable direction, such as laterally, upwards, or downwards. For example, the lens 505 may direct light towards a reflective element, such as a ceiling comprising reflective tiles or reflective surfaces of the heat sink 110. In addition, the lens 505 may be configured and positioned in any appropriate manner to direct light in the desired direction.

For example, referring to FIGS. 3-6 and 21, a lens 505 may be positioned in the LED unit 115 directly above the LED lamp 105 such that the light emitted from the horizontal upwardly facing LED lamp 105 may enter the lens 505 and be directed away from the LED unit 115 in a desired direction. The lens 505 may comprise a high efficiency lens, such as transmitting at least 94% of the light received from the LED lamp 105 to the target surfaces, such as the ceiling, walls, floors, etc. In addition, the lens 505 may be adapted to exhibit a low profile to ensure clearance from the ceiling. In various embodiments, the lens 505 may comprise a set of thin reflective planes configured to reflect light away from the aperture through which light from the LED lamp 105 is received.

For example, referring to FIGS. 4C, 4E-H, 5, and 21, an internal portion of a suitable lens 505 may comprise one or more Lambertian surfaces, arrays, or elements adapted to inhibit light from being trapped with the LED unit 115 or being reflected back towards the LED lamp 105. In one embodiment, the lens 505 may comprise multiple planar elements connected together. The planar elements may be optically transparent with very low intrinsic transmission losses. One surface of the planar elements may comprise a substantially optically flat surface and the other surface may comprise a set of highly reflective prisms, forming an array that is predominantly parallel to the optically flat surface. The prisms may also be primarily parallel and horizontal.

The planar parts may be highly reflective (such as 98%) mirror thin film. This may be accomplished with a highly reflective (such as 98%) white Lambertian reflector. The planar parts may be optically transparent, with very low transmission losses and may be optically flat on both sides.

The lens 505 may comprise an input aperture to allow light to enter. The opening size may be very close to the extent of the light source. A horizontal Lambertian reflector may be adjacent to the input aperture. The lens 505 may also comprise an interior tent and an exterior tent. The interior tent may be formed by two planar parts immediately above the input aperture with the ends of the tent formed by two optically flat and transparent parts. The top of the interior tent is then aimed at the target surface. The interior tent may have a peak angle. The interior tent may also be symmetric. The interior tent may also be shaped as a radially symmetric cone. Finally, the text surfaces may bulge outward, and the length and width of the text may be larger than the extent of the light source.

The exterior tent may be formed by two planar parts placed symmetrically in an orientation similar to the interior tent, with the parts being placed a greater distance apart relative to the corresponding parts in the interior tent. There may be a principal surface in the exterior tent that may have an angle with respect to the principal surfaces of the interior tent. The angles may be such that the exterior tent becomes inverted and truncated. The exterior tent may have optically flat and transparent parts, the tent surface may bulge outward, the tent may be a radially symmetric truncated cone, and the maximum height of the tent may be roughly the same as the interior tent. The openings between the top end of the interior and exterior tents may be covered with highly reflective mirror thin film, highly reflective Lambertian white reflective thin film, or another aforementioned planar part.

The lens 505 may redirect light with very low loss. The redirected light may be reflected or transmitted (turned away from vertical). The reflected light primarily goes toward the opposite tent surface, where it is reflected or transmitted. The tent angles are selected such that very little light is transmitted or reflected directly normal to the ceiling. Light that is directed nearly normal to the ceiling is reflected or directed away from normal (the zenith) by the mirror film, the Lambertian reflected film, or a dominant planar part placed horizontally immediately above the tents. The reflected light has no direct path to the input aperture; it must interact with one of the tents so that some light reaches the system exterior. Light that is directed back to the source, but not directly to the input aperture, but not exactly to the input aperture, will be efficiently reflected by the white Lambertian reflecting film.

The symmetry of the lens 505 may be designed to match the symmetry of the distribution of the light sources. For example, a rectangular distribution may correspond with 2-fold symmetry. A square distribution may correspond with 4-fold symmetry or radial symmetry.

The lens optics may be used to define performance characteristics. A specified mounting height from a reflected surface and a spacing in the X direction and Y direction with a lamp lumen output will yield a uniformity ratio of max to min light value. For example, in an exemplary embodiment, at a mounting height of 24" from a reflected surface and a spacing of 4' in the X direction and 10' in the Y direction with a lamp lumen output of approximately 1,000 lumen, the uniformity ratio of max to min light value will not exceed 2.0:1.0. The lens optics may be designed for any suitable mounting height. In exemplary embodiments, the lens optics may comprise a mounting height of 16-32" from the reflective surface.

Figure 3:
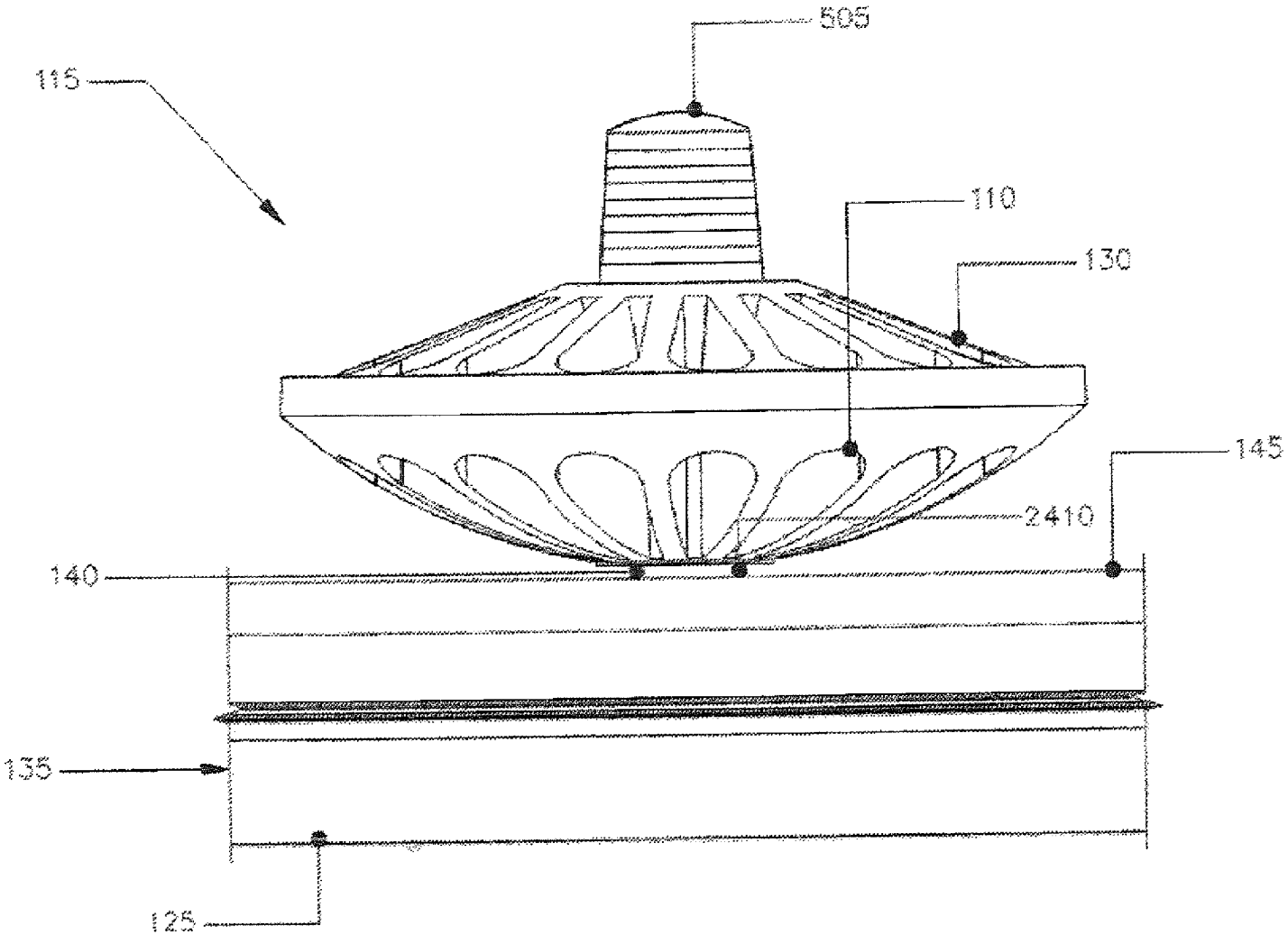
FIG. 3 representatively illustrates a side view of a wire way bar and an LED unit.
Figure 4B:
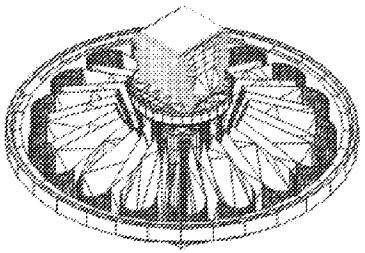
FIGS. 4A-H representatively illustrate an LED unit and a lens.
Figure 4D:
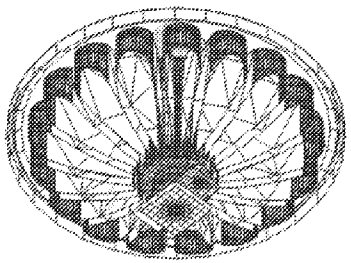
Figure 4A:
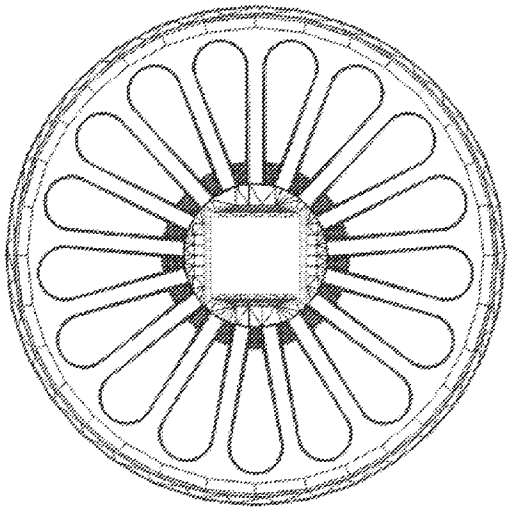
Figure 4C:
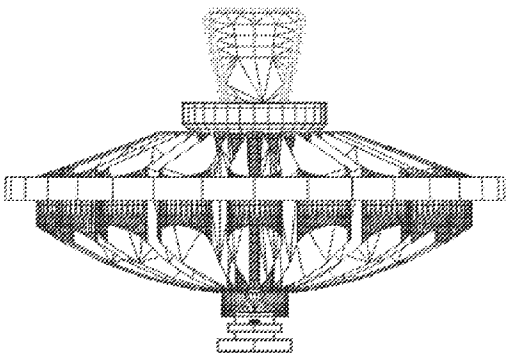
Figure 4F:
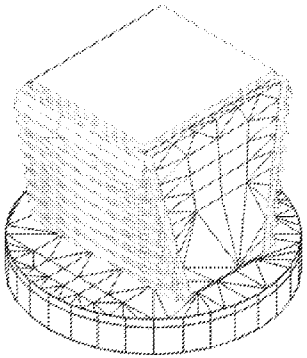
Figure 4H:
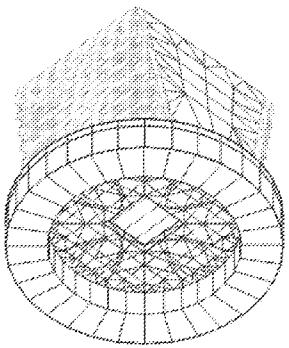
Figure 4E:
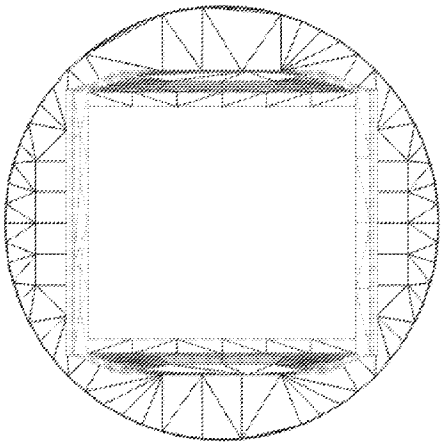
Figure 4G:
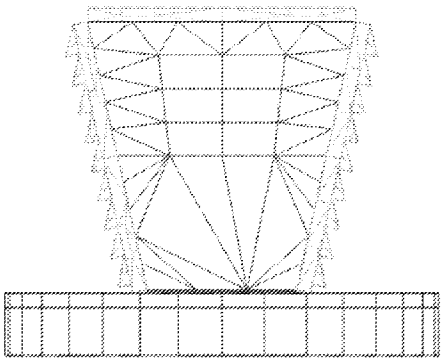
Figure 5:
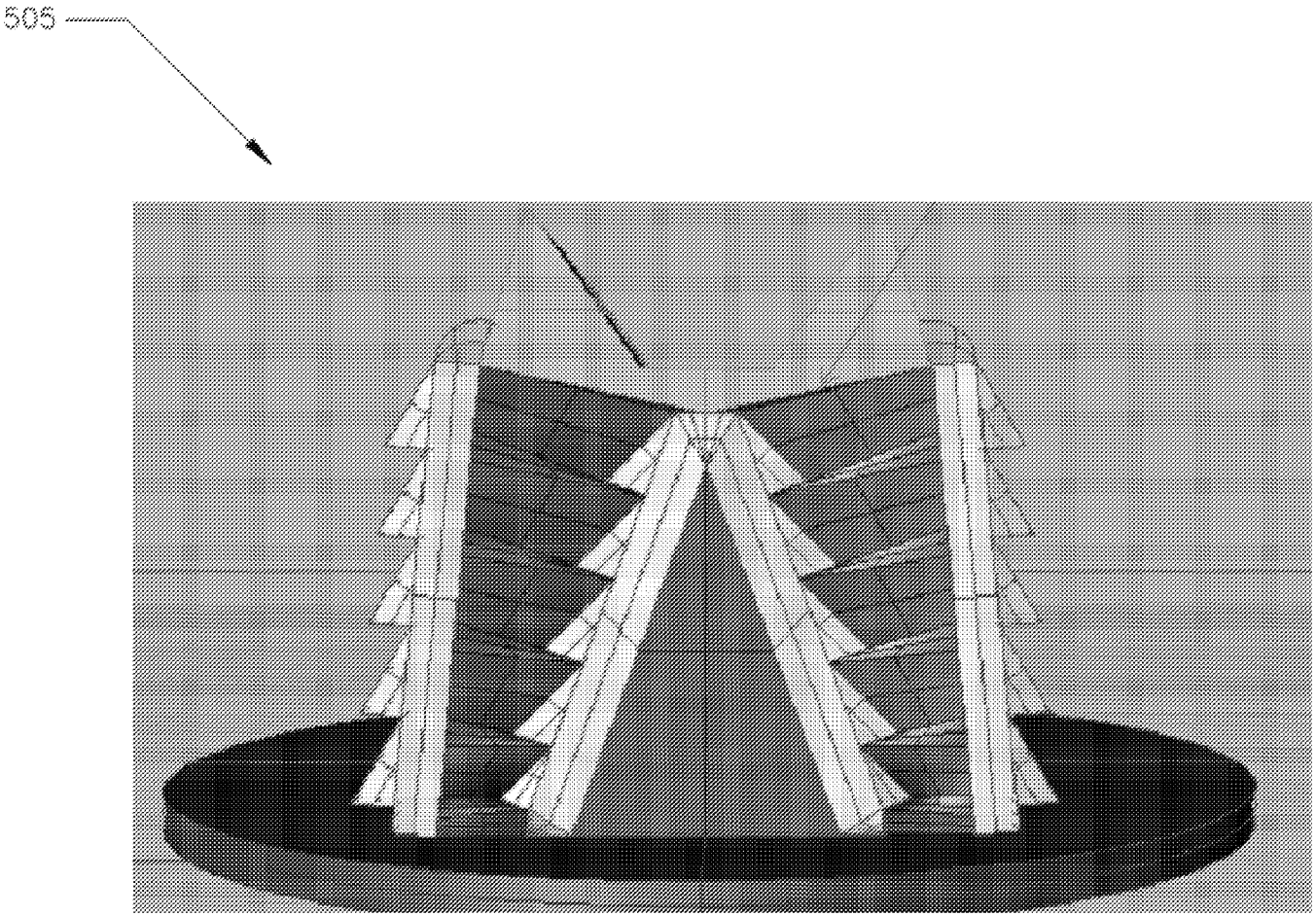
FIG. 5 representatively illustrates a cross-section of a lens.
Figure 6:
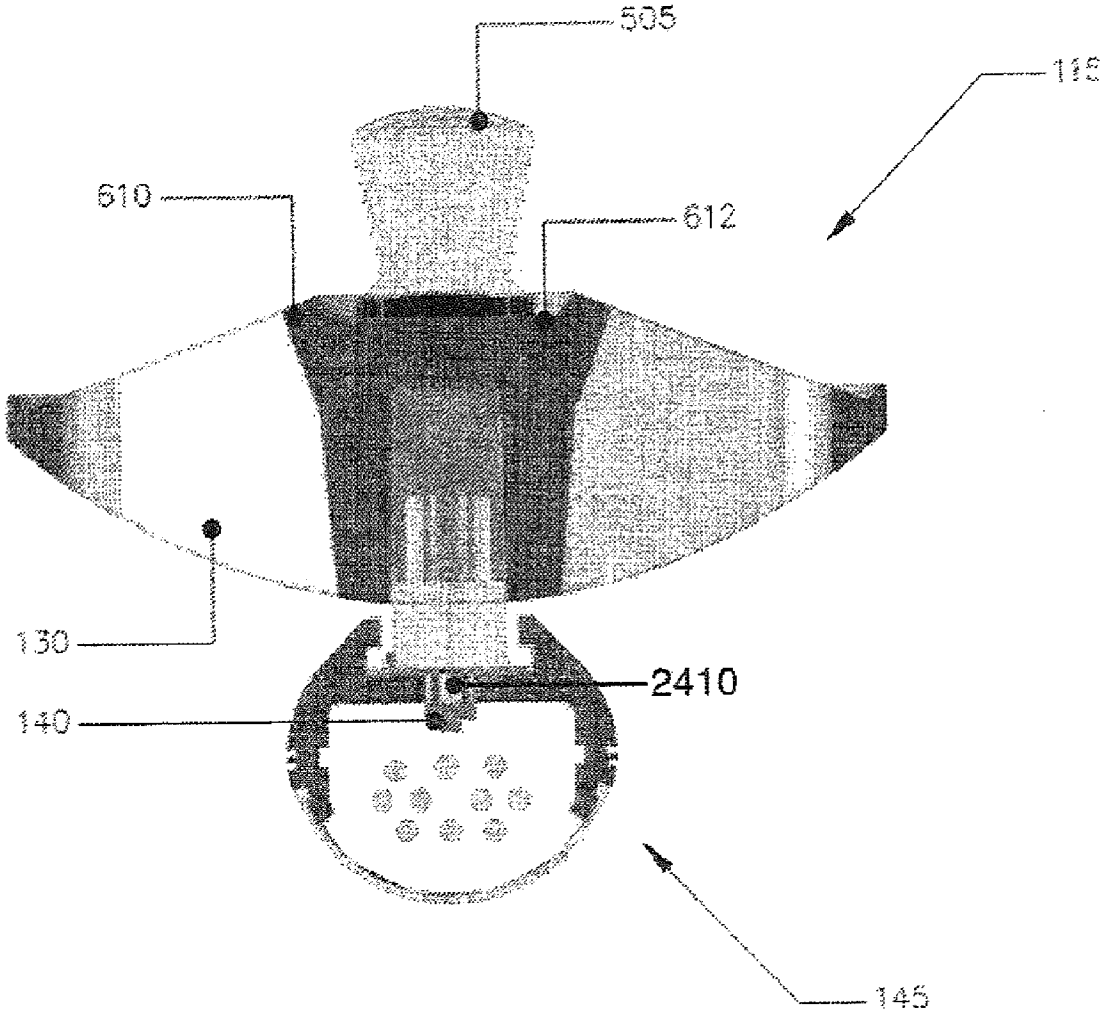
FIG. 6 representatively illustrates a cross-sectional view of the wire way bar and the LED unit with the lens.

Referring to FIGS. 3 and 6, the LED unit 115 may further comprise a heat sink 110 for cooling the LED unit 115, such as a conventional heat sink coupled to the LED lamp 105. The heat sink 110 may comprise any suitable material for absorbing and/or dissipating heat produced by the LED lamp 105. For example, a suitable material may exhibit a high thermal conductivity, such as copper and/or aluminum. In one embodiment, the heat sink 110 comprises a disk-like die-cast aluminum heat sink with radial fins 130 originating at a core 610. In one embodiment, the heat sink 110 is configured to exhibit low drag in response to airflow. Because the heated air around the LED lamp 105 and the heat sink 110 rises, the low drag tends to promote airflow around the heat sink 110, similar to the draft effect of a chimney. In the present embodiment, the heat sink 110 form is scalable and can be reduced or increased per illumination requirement.

The heat sink 110 may dissipate heat from the LED lamp 105 in any suitable manner. For example, the core 610 may have a surface area of sufficient size to effectively dissipate heat generated by the LED lamp 105. The core 610 may also be suitably configured to fit against the LED lamp 105 to increase the surface area contact to aid in heat transfer from the LED lamp 105 to the heat sink 110.

The core 610 absorbs heat generated by the LED lamp 105 and transfers the heat to the radial fins 130. A hole in the core 610 may accommodate power lines from the sink's bottom connect to the lamp, which may be seated in a lamp cavity 612 formed in the top of the core 610. The lamp cavity 612 houses the LED lamp 105 and at least partially conceals the LED lamp 105 from view. The LED lamp 105 may be mounted directly, via a thermally conductive adhesive, a fastener system, a weld, or indirectly, such as in conjunction with a thermal pad, onto the floor of the lamp cavity 612, and may include an asymmetrical or symmetrical lens encapsulating the lamp cavity 612. In this embodiment, the LED lamp 105 may be attached to a material such as silicon, which may then be attached to the heat sink 110. Thus, the heat sink 110 may operate in open air with the LED lamp 105 on the heat sink 110 top and power and control connectivity from below through the heat sink's core 610.

The bottom of the core 610 may define a receptacle to accommodate a connector for connecting the LED unit 115 to the wire way bar 145. The receptacle orientation may be keyed or otherwise configured to only permit connectivity to pre-approved devices having the ability to discern the device type. The receptacle may connect to appropriate systems, such as a plug or an extender. The connection may be removable to permit removal and replacement of the LED unit 115.

The radial fins 130 may protrude radially outward from the core 610 of the heat sink 110. The radial fins 130 may be integrated with the heat sink 110, increasing the heat capacity of the heat sink 110. In various aspects of this embodiment, air spaces may be located between the radial fins 130 to increase the rate of heat dissipation by allowing passive airflow through the radial fins 130. In an aspect of this embodiment, the spaces may span the length of the radial fins 130 such that the tips of the radial fins 130 are separated. Space between the radial fins 130 induces heat removal primarily by convection. The heat sink 110 may capitalize on natural air flow from cold to hot. For example, the radial fins' 130 thickness may vary with thick walls on top and thin walls at the bottom, which may promote differential in air pressure to further induce air flow.

Figure 7:
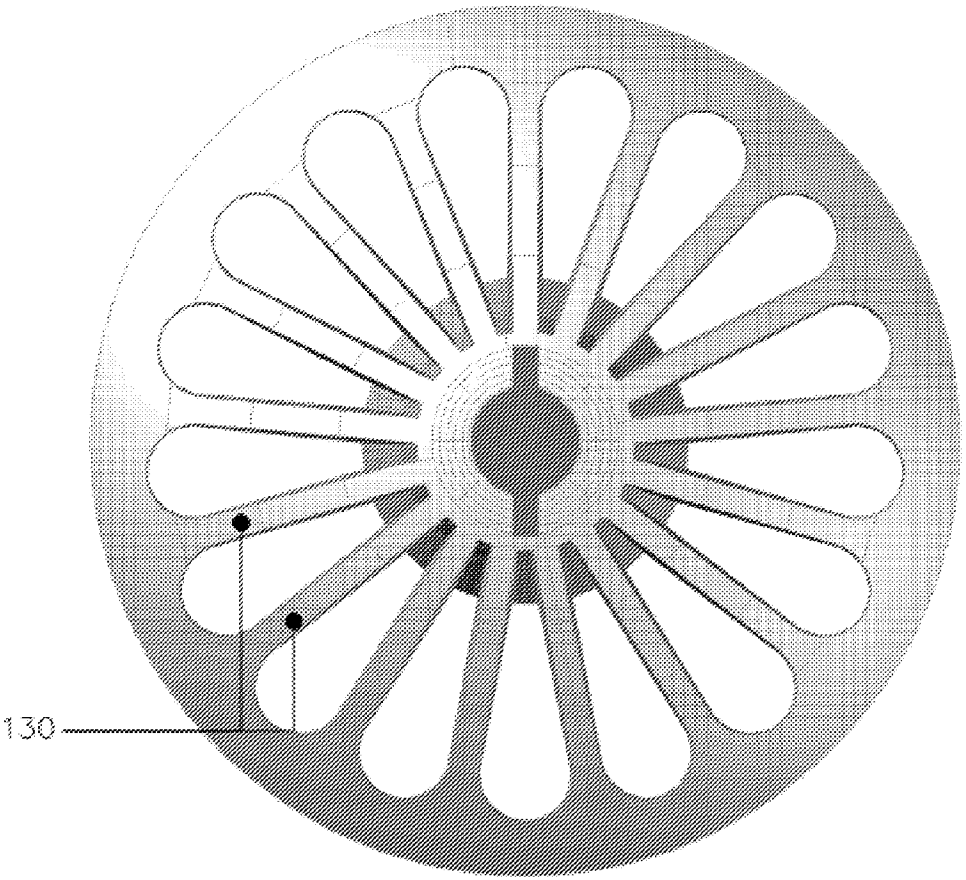
FIG. 7 representatively illustrates a bottom perspective view of the LED unit in accordance with an exemplary embodiment of the present invention.
Figure 8:
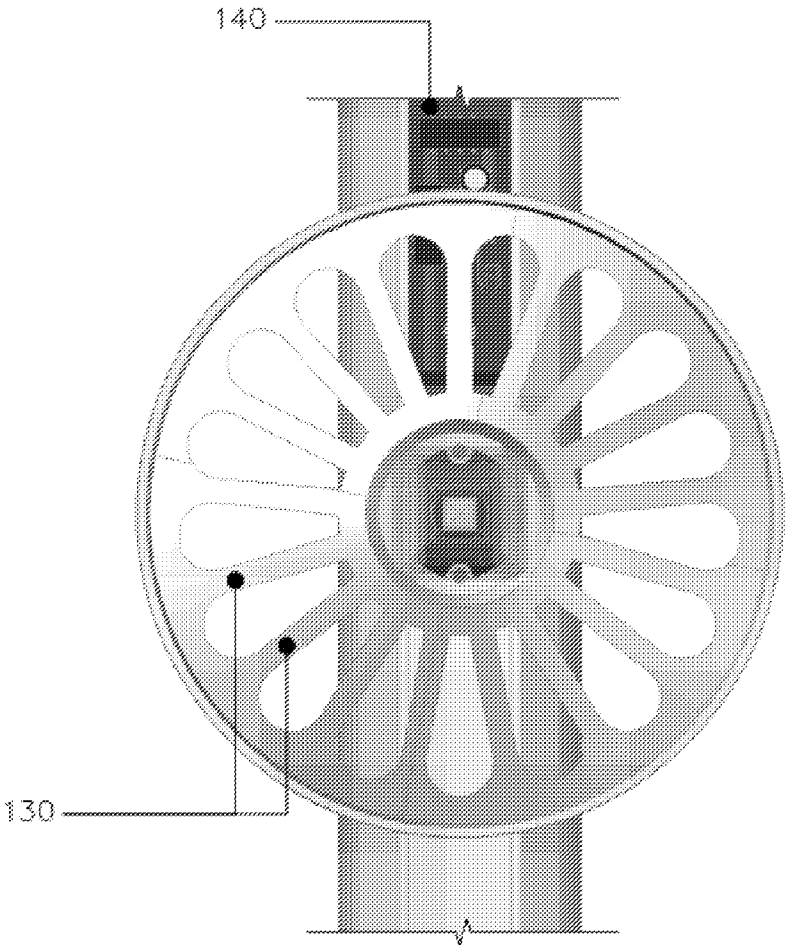
FIG. 8 representatively illustrates a top perspective view of the wire way bar, an adapter unit, and the LED unit in accordance with an exemplary embodiment of the present invention.

Referring to FIGS. 3, 7, and 8, in another aspect of this embodiment, the portions of the radial fins 130 that are farthest from the core of the heat sink 110 may be connected such that the spaces for passive air flow may be directed to the heat sink 110. The radial fins 130 may comprise any material that may absorb and/or dissipate heat from the LED lamp 105. For example, the radial fins 130 may comprise a metal such as aluminum. Further, the heat sink 110 and the radial fins 130 may be fabricated as a single piece or the radial fins 130 may be attached to the heat sink 110 by any suitable method, such as welding.

Referring to FIG. 3, the lighting system 100 may also comprise a secondary cooling device. The secondary cooling device (not illustrated), such as a fan, may be attached to the heat sink 110 or other component. The secondary cooling device may include any suitable system, such as a vibrating diaphragm like a synthetic jet ejector array that may operate by the low vibration of the diaphragm to circulate air. The heat sink 110 substrate may comprise a ledge or a notch for attachment of the secondary cooling device. The secondary cooling device may be attached to the heat sink 110 by any suitable connector, such as an adhesive, a mechanical fastener, and/or a weld. The secondary cooling device may be configured to draw air through the spaces in the radial fins 130 to cool the LED lamp 105. The secondary cooling device may be coupled to the adapter unit 140 for at least one of power and control. The secondary cooling device may be powered by house power and/or by ambient light produced by the LED lamp 105, for example using a photovoltaic element and/or by heat produced by the LED lamp 105 by a mechano-electric element.

The LED unit 115 and other components may be adapted to connect directly to the wire way bar 145, such as via a standard connector. Alternatively, various components, such as the LED unit 115 and other components, may be adapted to connect to the wire way bar 145 or otherwise operate in conjunction with an adapter unit 140 or other appropriate interface. The adapter unit 140 may facilitate connection of components to the wire way bar 145, such as for initial installation or replacement. In addition, the adapter unit may include other functionality, such as to control the LED unit 115 or other components or to otherwise interact with the components.

In various embodiments, the adapter unit 140 comprises an onboard microprocessor, which may identify to a remote control system the installed device type, function, model, and/or location. After establishing communication between the device's or the adapter unit's 140 microprocessor and the control system, the specific device's operational programming may take over. In conjunction with a specific device address or other communication technique, the device and adapter unit 140 may operate as a stand alone system as well as interact with some or all other devices. Where there is no need for a specific device control, a simple extender adapter unit 140 provides power. The adapter unit 140 may host a family of devices, such as speakers for public address, music, audio alarms, and noise cancellation; intrusion detectors (infrared, ultrasonic, and lasers); video cameras; communications systems, such as wireless internet access and RF communication; Fire/HAZMAT protection, including smoke, gas, and heat detectors; operational surveillance systems; environmental controls, including occupancy, particulate content, temperature, photo, and humidity sensors; and emergency systems, such as egress path, strobe lights, alarming, and command control interfacing. Overlapping functional requirements may reduce dependency on several types of devices, thus reducing cost and enhancing versatility.

For example, referring to FIGS. 3, 6, 8, and 20, the LED unit 115 and other components may be configured to couple to the adapter unit 140 to receive power from the wire way bar 145. In one embodiment, the adapter unit 140 may comprise a card adapted to engage the wire way bar 145, such as in a channel formed on the top of the wire way bar 145. The adapter unit 140 may comprise any suitable elements to facilitate connection of components to the wire way bar 145 or other functions.

For example, an exemplary adapter unit 140 may include a control interface or a mechanical interface or both. The control interface facilitates controlling the component, such as controlling the activation or brightness of the LED unit 115. The mechanical interface facilitates connection of the component to the wire way bar 145. The control interface and the mechanical interface may be on the same card or they may be on two separate cards that may be coupled together.

The mechanical interface may comprise any appropriate system for facilitating the mechanical connection between a component and the wire way bar 145. For example, the wire way bar 145 may be equipped with one or more ports 2410 for receiving components. Components may be plugged directly into the ports 2410 or may be connected to the port 2410 via the adapter, unit 140 mechanical interface. In the present embodiment, the mechanical interface comprises a standardized receptacle 2010 for coupling to multiple types of components. For example, the mechanical interface may comprise a particular external shape 2012 configured to mate with corresponding surfaces in various components. In addition, the mechanical interface may facilitate electrical connections between the component and the wire way bar 145, such as by providing an electrical connector 2016 through the receptacle 2010. The mechanical interface may also include electrical connectors 2014 for connecting to the wire way bar 145 wires through the port 2410 in the wire way bar 145.

The control interface facilitates controlling the component. The control interface may be adapted to connect to and control one or more types of components, such as the LED unit 115. The control interface may include any suitable elements or functions, such as sensors, controllers, power converters, and constant current sources. The adapter unit 140 may also comprise a self identifying chip, which may identify and communicate with a device coupled to receptacle 2010. The chip is optional and there are several chip configurations that may be used.

Figure 22:
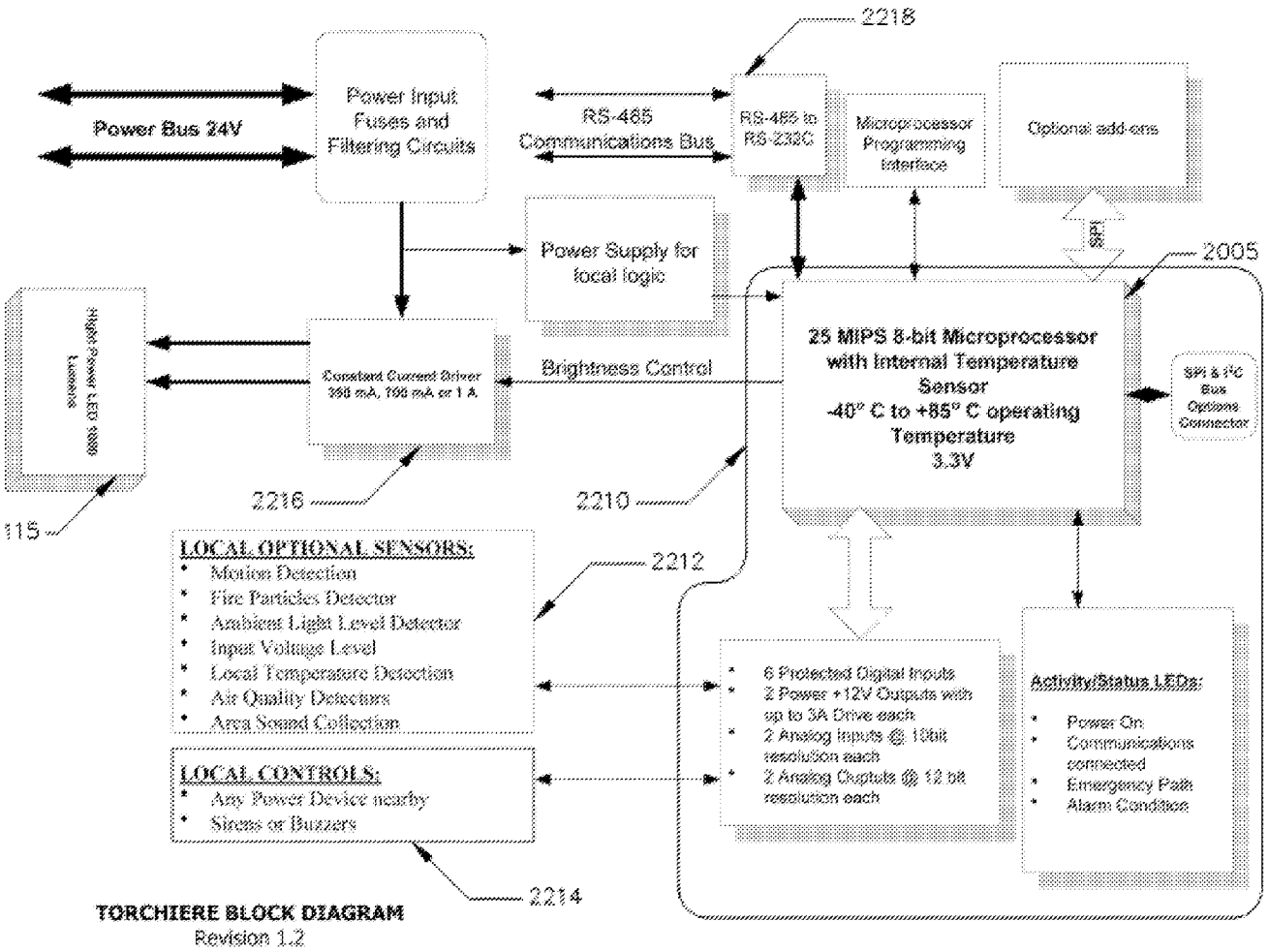
FIG. 22 is a block diagram of an adapter card and other electronic devices.

In one embodiment, the control interface includes a microprocessor-based control system for controlling various functions of components and communicating with other systems. For example, referring to FIG. 22, an exemplary control interface 2210 may receive input signals from one or more sensors 2212 and/or local control elements 2214. The signals may be processed by a microprocessor 2005 to control the LED unit 115, such as via a current driver circuit 2216. The microprocessor may also be adapted to communicate with other systems, such as via a communications interface 2218. Thus, the microprocessor 2005 may control component functions according to local signals from nearby sensors or according to communications from remote systems.

The control interface may implement any appropriate functions. For example, dimming capability. The control interface may facilitate the ability to control the light output autonomously for different situations and environments. In addition, the control interface may facilitate communications with other systems. By adding communications capability, multiple units may be commanded remotely from within or outside a building to dim, turn off, or turn on. The communications capability may use an industrial network that allows the grouping of many of these units into the building structures and controlling them together or in groups depending on the requirements or their positions in the building surface. The control interface may facilitate other functions, such as ambient light level detection, movement detection, local temperature readings, and air quality sampling.

Thus, the control interface may facilitate data collection for an area in the building, permitting enhanced oversight of the air quality on the floor, including the heating/air conditioning and air filtration systems. Data may be collected in one central location and converted into detailed maps and reports. These maps and reports allow the management of the building to enhance control of energy expenditure and use.

In one embodiment, the microprocessor 2005 may be programmed to detect a type of device coupled to the adapter unit 140 and control the device accordingly, effectively creating a "plug and play" type system. For example, the microprocessor 2005 may read pins or other identification information from a component when it is installed on the mechanical interface. The processor microprocessor 2005 may then control the component accordingly. The processor microprocessor 2005 may also report the connection and status of the component to a remote system, such as a building server. The control interface 2210 and the mechanical interface may be operable with any number of components, such as the LED unit 115, a motion detector, a light sensor, a video camera, an audio recording and/or broadcasting system, a fire detector, an air quality detector, a carbon dioxide detector, and the like.

In a representative embodiment, the microprocessor 2005 may control the brightness of the LED lamp 105 such as by dimming the light to a pre-selected intensity. Referring now to FIGS. 11-14, the microprocessor 2005 may also control the brightness of the LED lamp 105 in response to environmental controls, such as in response to a photocell sensor subassembly 1300 and/or an occupancy sensor subassembly 1100. For example, the microprocessor 2005 may turn on the LED lamp 105 to the pre-selected intensity at one end of a room, such as an office, where the occupancy sensor subassembly 1100 detects movement. In addition, the microprocessor 2005 attached to the LED lamp 105 on the other end of the room may turn off the LED lamp 105 where the occupancy sensor subassembly 1100 detects no movement.

The microprocessor 2005 may also dim the LED lamp 105 when the photocell sensor subassembly 1300 detects that there is sufficient light, such as from a nearby window. Similarly, the microprocessor 2005 may increase the light emitting from the LED lamp 105 when the photocell sensor subassembly 1300 detects low light. Thus, the microprocessor 2005 may minimize and/or optimize the amount of electricity needed to power multiple LED lamps 105, decreasing the energy consumption costs required to operate the lighting system 100.

The control interface 2210 may facilitate any appropriate functions for the various components. For example, referring to FIG. 23, various integrated and interfaced functions may be performed in conjunction with different types of components such as the LED lamp 105, speakers, cameras, antennas, photo sensors, occupancy sensors, air quality sensors, thermal sensors, smoke sensors, humidity sensors, and the like. Referring to FIG. 23, integrated functions may include ambient lighting, emergency lighting, daylight harvesting, lighting energy management, public announcement, music, noise cancellation, alarming for burglary or fire, operational surveillance, wireless hotspot, radio frequency transmissions, maintenance, and the like. The integrated functions may detect from one or more devices and then respond by involving one or more devices. The control interface 2210 may also facilitate interfaced functions, such as HVAC, fire department, police department, tampering alerts, operational server logs, and the like.

The adapter unit 140 may be configured to operate using any suitable power source, such as standard A/C power or D/C power. The adapter unit 140 may also be configured to operate on a low voltage system, such as 24-volt input power. In an alternative embodiment, the adapter unit 140 may be adapted to operate using multiple power sources such as might be provided by a battery powered back-up system after loss of a primary power source.

In an exemplary embodiment, the components of the lighting system 100 may be interchangeable to allow for the updating and/or reconfiguration of the components. For example, the heat sink 110 with the attached LED lamp 105 may be removed from the adapter unit 140, and replaced with a different heat sink 110 or LED unit 115 altogether that may have a different shape, size, or configuration. In addition, the microprocessor 2005 in the adapter unit 140 may be replaced with a different microprocessor and/or a secondary cooling device may be added to the heat sink 110. Further, any other components or any pieces of any of the components may be interchangeable. The interchangeability of any of the components of the lighting system 100 may result in its adaptability to the lighting needs or other functional needs of any user and the updateability of the components as next generation components become available.

Any suitable components may be adapted for the lighting system 100, including lights, speakers, cameras, antennas, and sensors. For example, referring to FIGS. 11 and 12, an exemplary occupancy sensor subassembly 1100 according to various embodiments of the present invention may be coupled to the wire way bar 145, such as with a connector 1105. The connector 1105 may comprise at least one of a mechanical and electrical connector between a housing 1110 and the adapter unit 140. The housing 1110 may comprise the sensor 1115 and may provide at least one of a mechanical and an electrical connection between the connector 1105 and the sensor 1115. The connector 1105 may extend from one or more points on the housing 1110, around the wire way bar 145, and be coupled to the adapter unit 140. In some embodiments, the occupancy sensor subassembly 1100 may be configured in a "wishbone" shape such that it can be easily pushed onto the wire way bar 145 and coupled to the adapter unit 140.

The occupancy sensor subassembly 1100 may comprise a sensor 1115 that may be directed to the space below the lighting system 100 such that the sensor 1115 may detect the movement of people. The sensor 1115 may sense the presence or absence of movement in the area around the lighting system 100 and communicate with the LED lamp 105 to maintain or modify the light emitted from the LED lamp 105.

Figure 14:
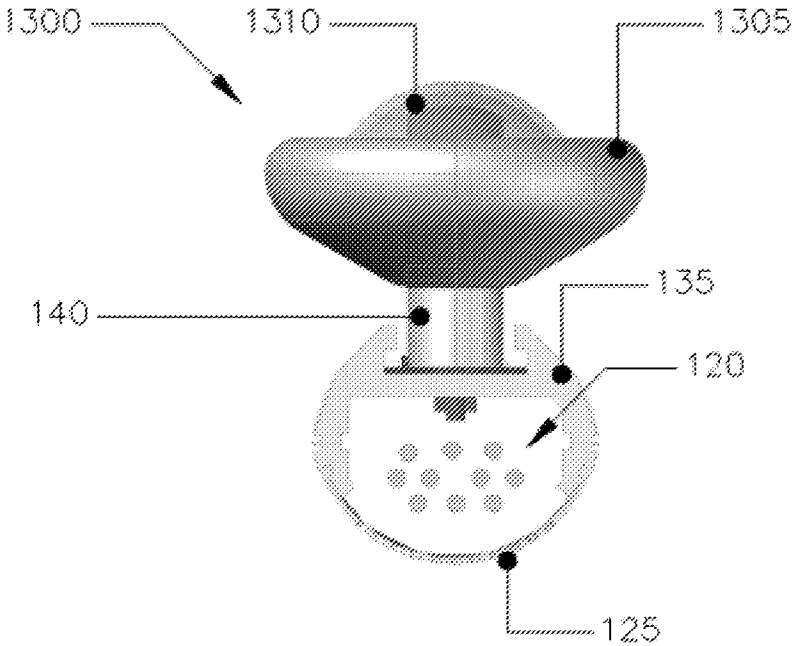
FIG. 14 representatively illustrates a cross-sectional view of the wire way bar and the photocell sensor subassembly in accordance with an exemplary embodiment of the present invention.
Figure 13:
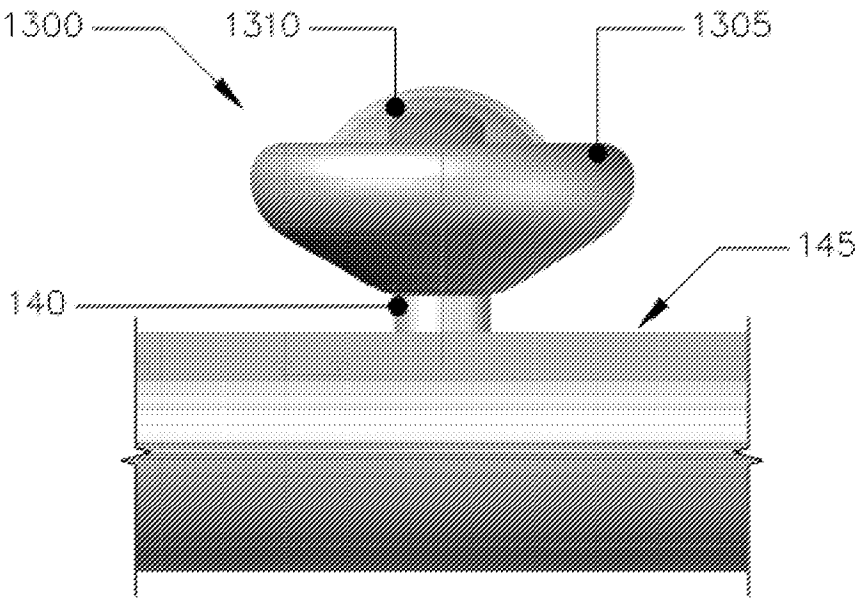
FIG. 13 representatively illustrates the wire way bar and a photocell sensor subassembly in accordance with an exemplary embodiment of the present invention.

Referring to FIGS. 13 and 14, an exemplary photocell sensor subassembly 1300 may be coupled to the wire way bar 145, such as through the adapter unit 140. The photocell sensor subassembly 1300 may comprise a housing 1305 and a photocell sensor 1310. The housing 1305 may provide at least one of a mechanical and an electrical connection between the adapter unit 140 and the photocell sensor 1310. The photocell sensor 1310 may sense the light levels in the area around the lighting system 100 and communicate the light levels to the LED lamp 105 to maintain or modify the light emitted from the LED lamp 105.

In some embodiments, a surveillance system (not illustrated) may be coupled to the lighting system 100. According to various aspects of these embodiments, the surveillance system may be coupled to the wire way bar 145 directly or via an adapter unit 140. The connection may provide at least one of power and communication capability to the surveillance system, such as, for example, communication between the surveillance system coupled to the lighting system 100 with a remote monitoring and/or control system.

The surveillance system may comprise any sensor and/or array of sensors that may monitor and/or detect audio, visual, and/or environmental conditions in an area proximate to the lighting system 100. For example, the surveillance system may comprise a camera, a video camera, an infrared camera, a camera sensitive to low light conditions, a cellular observation device, a voice recognition system, an alarm system, and/or a sensor for detecting chemical anomalies, such as flammable fumes, toxic fumes and gases, smoke, and fire. The surveillance system may also comprise an audio component, such as a microphone and electronic memory, that may record any sounds emitted during the sensed condition. In some aspects, the surveillance system may be a small size and/or camouflaged to avoid detection, such as by the casual observer. In some aspects, the surveillance system may be able to receive a signal from a remote monitoring and/or control system in response to the sensed condition. The signal may direct the surveillance system to commence a response to the sensed condition, for example dispensing a fire retardant and/or water, sounding an alarm, and/or providing audio instructions for evacuation. In an aspect of these embodiments, a fire retardant system and/or sprinkler system may be integrated into or connected to the lighting system 100.

The surveillance system may be implemented with one or more microprocessors, RAM-storage devices, and/or any other suitable component for storing, communicating, and/or responding to the sensed condition. The surveillance system may sense a condition in the area proximate to the lighting system 100 and communicate the condition to a remote receiver such as a police, tire, or security monitoring station, and/or to any other remote monitoring and/or control system.

In some embodiments of the present invention, an audio system (not illustrated) may be coupled to the lighting system 100. According to various aspects of these embodiments, the audio system may be coupled to the adapter unit 140 for at least one of a mechanical and electrical connection between the audio system and the lighting system 100, such as for providing power to the audio system. The audio system may comprise any suitable components to detect and/or project sound, such as a speaker and a microphone. A remote transmitter or base station may wirelessly transmit sound to the audio system, or may be connected via the wire way bars 145. The audio system may project any desired sound such as announcements, music, and/or an alarm.

The wire way bar 145 provides connected devices with power and/or data transmission used for control of the device. The wire way bar 145 may also provide physical support for the devices connected to the wire way bar 145. The wire way bar 145 may comprise any suitable system for supporting and supplying the devices, such as one or more wires within a conduit. For example, the wire way bar 145 may comprise one or more cables and a hollow structure containing the cables. Referring to FIGS. 1 and 2, the hollow structure may be defined by, for example, a wire way channel 135 coupled to a wire way cover 125.

The wire way channel 135 defines an area for containing the cables and supports the devices connected to the wire way bar 145. The wire way channel 135 may be may be coupled to the wire way cover 125 in any suitable manner, such as a tongue and groove connection, adhesive, a weld, and/or a fastener. The wire way channel 135 and the wire way cover 125 may comprise any suitable material such as a metal, a plastic, a fibrous mineral board, a fabric, and/or a composite material. In an aspect of the embodiments, the wire way cover 125 and/or the wire way channel 135 may comprise a thermally conductive material such as aluminum that may further dissipate heat generated by LED lamp 105. For example, the heat sink 110, the adapter unit 140, and at least one of the wire way cover 125 and the wire way channel 135 can be in thermal contact to facilitate the dissipation of heat generated by the LED lamp 105. The wire way cover 125 may also be perforated to aid in heat dissipation.

The wire way bar 145 may be mounted on a structure. In various embodiments, the wire way channel 135 is suspended from the ceiling, such as via cables, or by connections to other suspended structures, for example other wire way bars 145. In the present embodiment, the wire way bar 145 may be hung about 12"-36" below a ceiling, such as a ceiling defined by acoustical tile or a hard ceiling, for example by aircraft cable or pendant. In addition, the wire way bar 145 may comprise a section adapted to be coupled to other wire way bars 145, such as in two-, four-, six-, eight-, and twelve-foot sections. In the present embodiment, the wire way channels 135 comprise slimline, small profile extruded aluminum sections, and operate as electrical and mechanical modular conduits. In other embodiments, the wire way bars 145 may be mounted on a wall or other structure.

Figure 25:
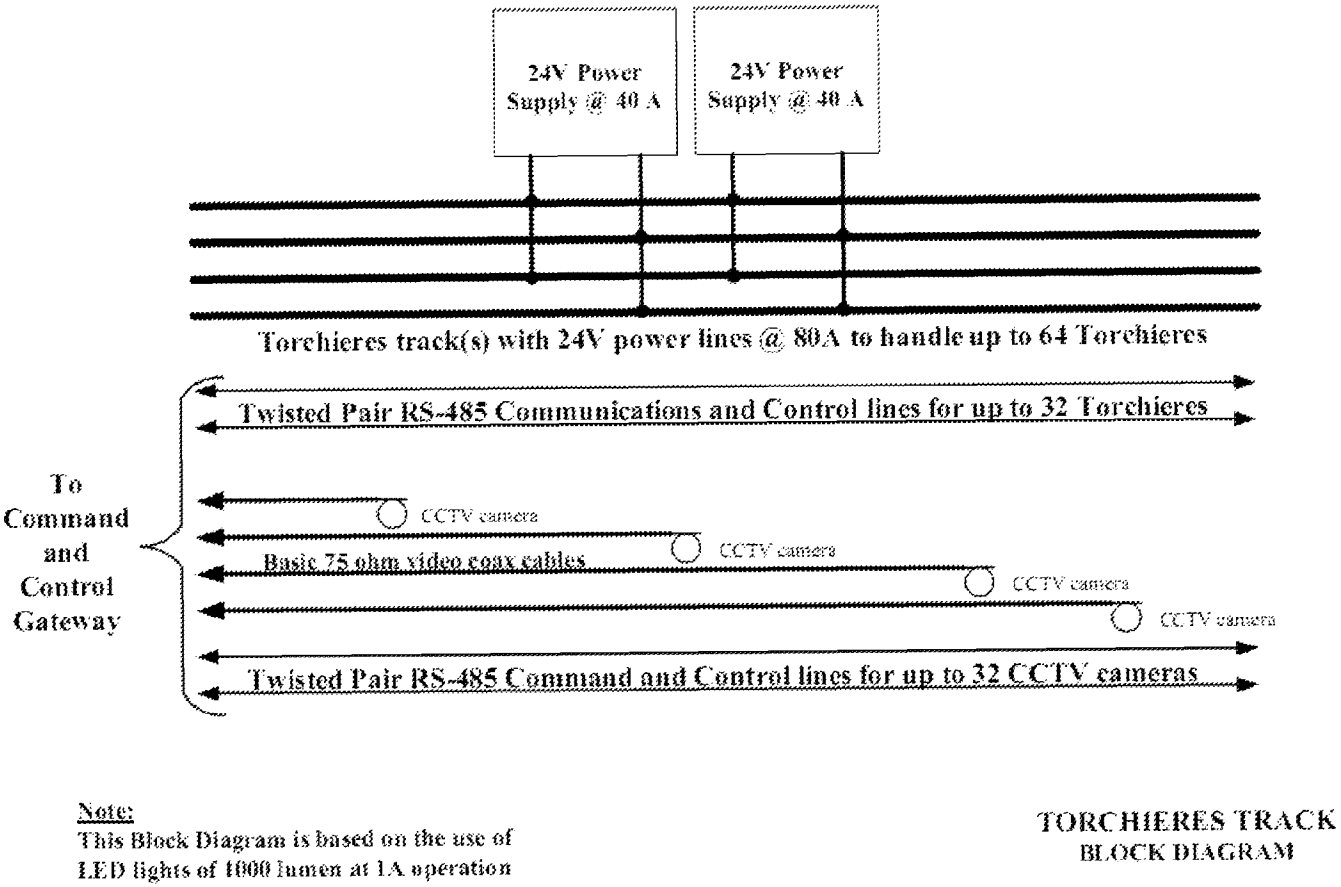
FIG. 25 illustrates connections for a wire way bar.

The cables within the wire way bars 145 may provide any appropriate functions, such as power, control, and data transfer, and may be implemented in any suitable manner, such as conventional wires and fiber optics. In the present embodiment, one or more wires 120 are disposed within the wire way bars 145 to supply power to the devices connected to the wire way channels 135. For example, referring to FIGS. 24A-B and 25, the wire way bars 145 may include conventional wires for delivering power to the LED units 115, such as 14-gauge copper wire for supplying 24V. The wire way bar 145 may also contain a communication link or control link, such as one or more twisted pairs according to the RS-485 standard. The wire way bar 145 may include any appropriate wires or links, however, such as 75-Ohm coaxial cable with digital synchronization for transmitting video signals for video components mounted on or otherwise connected to the wire way bars 145. The wires 120 may be adapted according to any desired functionality and application, including power supply, communications, wireless, control, sensor data, audio signals, digital or analog signals, video signals, and digital data signals. Further, the wires 120 and the wire way bars 145 may be prefabricated in the lighting system 100.

The wire way bar 145 may also comprise one or more ports 2410 configured to provide an access point for connecting a device or adapter unit 140 to one or more of the wires 120, such as for power supply, communications, and control. The port 2410 may also provide a mechanical attachment point for attaching devices to the wire way bar 145. The port 2410 may comprise, for example, a hole formed in the top of the wire way channel 135, and may include a fitting such as a metal tube, pipe, and/or an electrical connection. In one embodiment, the port 2410 comprises a universal connector that connects to multiple devices or adapter units 140. The port 2410 may facilitate connection of the device to the wires 120 and wire way channel 145 in any suitable manner, such as a friction fit, tongue and groove connection, adhesive, a weld, and/or a fastener.

For example, referring to FIGS. 3 and 4, the LED unit 115 may be coupled to the wire way channel 135 via the adapter unit 140. The adapter unit 140 may include a male connector which is disposed through the port 2410 to engage the port 2410 and establish an electrical connection, such as via a socket. The electrical connection may establish at least one of a power connection and a control connection. The port 2410 may be configured physically, such as via an asymmetric structure, to ensure proper orientation of the male connector relative to the port 2410.

In various embodiments of the present invention, lighting system 100 may comprise any number of ports 2410 such that a corresponding number of the LED units 115 or other devices may be mounted on the wire way bar 145, such as either directly or via the adapter units 140. Consequently, the lighting system 100 may be adapted to different configurations of LED units 115 and/or other components according the particular environment. The number and/or pattern, array, or sequence of the LED units 115 and other devices along the various wire way bar 145 may be determined by one or more factors, such as energy consumption, HVAC limitations, and costs.

The wire way bar 145 may also include coupling mechanisms for mechanically, electrically, or otherwise connecting the wire way bar 145 to an adjacent wire way bar 145 or other system. The coupling mechanisms may comprise any suitable electrical and/or mechanical connector. For example, each end of the wire way bar 145 may include a mechanical connection to engage a corresponding mechanical connection on an adjacent wire way bar 145, or may be configured to engage a connector structure for joining two wire way bars 145. In one embodiment, the mechanical connector may comprise a rod, a locking connection, a fastener or a fastener apparatus, and/or an adhesive. The mechanical connector may provide rigid stability to an installed lighting system 100 as well as flexibility to configure multiple modularly coupled lighting systems 100.

In addition, the wires 120 may terminate in one or more electrical connectors adapted to connect to a corresponding connector, such as an electrical connector on an adjacent wire way bar 145. For example, the wires 120 may terminate in a ribbon connector or bracket to mate with a corresponding connector or bracket. Using the mechanical and electrical connectors, the wire way bars 145 may be connected to form longer wire way bar 145 assemblies to create modular lighting systems 100. In one embodiment, the electrical connector may comprise a temporary connector such that the modularly assembled lighting system 100 can be dissociated from another lighting system 100 for disassembly, redesign of a lighting scheme, shipment, and/or storage of the lighting system 100. In another embodiment, the electrical connector may comprise a permanent hardwire connector. Further, the lighting system 100 may be modularly assembled to quickly connect components, devices, and other lighting systems 100 with little effort or setup required.

Lighting system 100 may comprise plug-in connectors at either or both ends of the wire way bar 145. The plug-in connectors may facilitate quick and easy connectivity between two wire way bars 145. The wire way bar 145 may comprise a female connector at one end and a male connector at the other end. In this manner, a female connector will connect with the male connector, allowing power and signal to flow between the wire way bars 145. These connectors may be joined by low voltage wires. The wires may be placed inside the extrusion and populated by pre-configured port connectors, making the entire wire way bar 145 ready to plug and play.

There may be a wire harness at one of both ends of wire way bar 145. The wire harness may include separate power, data, and control wires, and the power line may also accommodate control signal. These wires may include 24V power lines, twisted pair RS-45, and basic 75 ohm coax cables. The connector's pin configuration may be designed to flow power continuously after confirming full engagement. The connector located at the end of the wire way bar 145 may be made of one or more materials, such as hardened plastics, ceramics, or any other materials, and the connector may have a mechanical means to be secured to the extrusion.

The mechanical connector may comprise a mechanism that connects the two parts together in a secure and permanent manner. This mechanism may allow for hanging the lighting system 100 from the ceiling. The connector may comprise two interlocking aluminum or similar material bars positioned over the joint. The bars may have at each end a bore to which screws may provide secured connectivity between the wire way bars 145. A threaded pendant may hang from the ceiling and connect to a threaded bore in the middle of the connector bars.

The lighting system 100 may include power supplies, control systems, and other elements to perform various tasks and/or interface with other systems. The other systems may be connected to the other elements of the lighting system 100 in any suitable manner, such as via the wire way bars 145. For example, referring to FIG. 25, the wires 120 disposed within the wire way bars 145 may be connected to other systems via a command and control gateway. For example, referring to FIGS. 18, 19, and 26, the lighting system may include power supply elements and control systems connected to the terminal wire way bars 145 at the end of a set of wire way bars 145.

Figure 18:
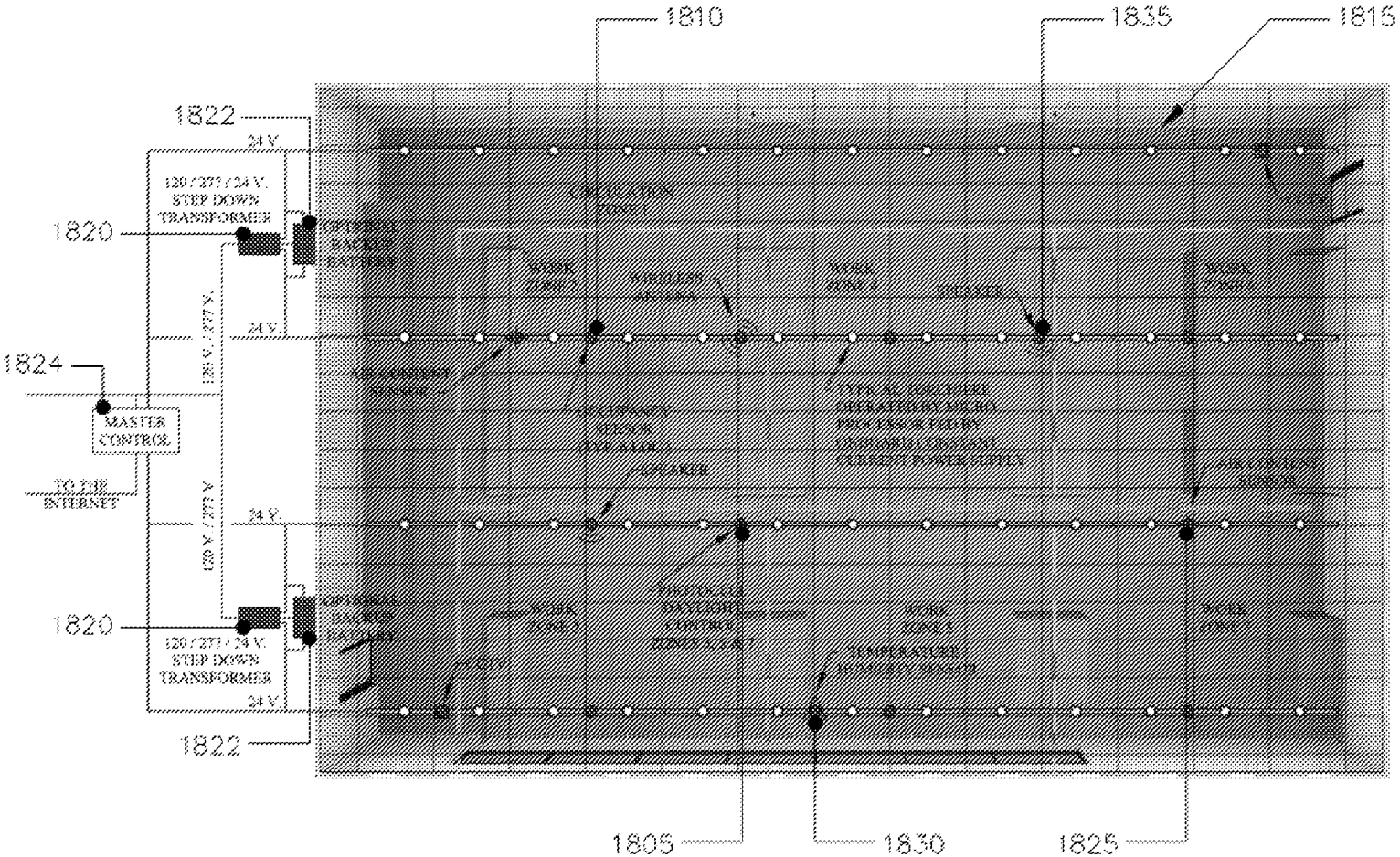
FIGS. 18 and 19 representatively illustrate ceiling-mounted environmental and lighting systems.

The power supply elements may comprise any suitable elements, such as transformers, connectors, filters, conditioners, converters, and the like. In the embodiment of FIG. 18, the power supply elements comprise one or more step down transformers 1820 for converting conventional 120V or 277V supply voltages to 24V for use by the LED units 115 and other devices. The devices in the lighting system 100, such as the CCTV cameras and sensors, may be equipped with dedicated power converters to convert the 24V or other supply voltage to a desired power supply signal. The power supply elements may comprise any other appropriate elements, such as backup batteries 1822. For example, the battery may provide emergency power to the lighting system 100 when the line power is not available. The battery may be appropriately located, such as concealed above the ceiling and/or in a battery box attached to a wall. Other power control elements may be implemented, such as in the adapter units 140, in the wire way bars 145, and/or in a remote location.

Figure 26:
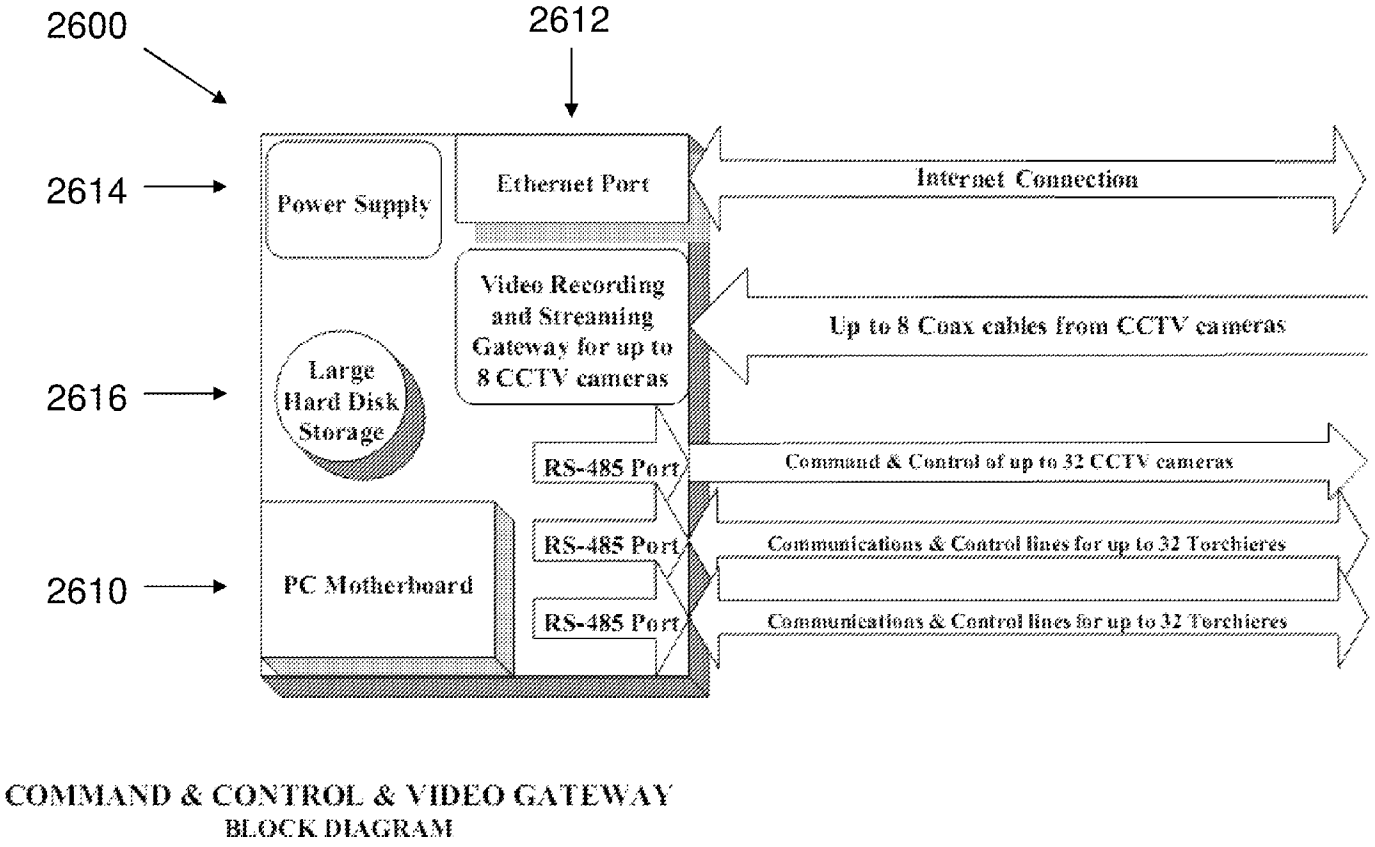
FIG. 26 is a block diagram of a control system.

Control systems may control various operations of the lighting system 100. The control systems may be implemented in any suitable manner and perform any appropriate functions, such as controlling lighting, logging and reporting environmental conditions, and transmitting data. Control systems may be dedicated to individual devices, may control the entire system or only parts, and may control individual devices in the lighting system 100, such as via addresses or other identifiers assigned to the various devices or groups or types of devices in the lighting system. Referring to FIG. 26, the control system 2600 may interact with the various elements of the lighting system 100 in any suitable manner, such as via coaxial cables, twisted pairs, or networking connections in the wire way bars 145. The control system 2600 may communicate via any appropriate medium or connection, such as wireless connections.

The control system 2600 may perform various functions, and may be configured with varying degrees of centralized control. For example, a relatively decentralized control system may carry line voltage and locally convert power to low voltage and possibly DC power for the system 100. A more centralized controller may be located at any appropriate location, such as anywhere between a control panel and a wire way bar 145. A centralized system containing a power supply, centralized controls, and optional back-up power may provide power and communication signals via dedicated ports. The centralized system may include a computer engine and may be located in a wall cabinet or concealed above the ceiling, away from high traffic areas.

The control system may communicate with the devices by dedicated line or through the power line. The control system may give the devices optimal operational range, and programming may include device self-reporting/alerts, address assignment, operation scheduling, and interaction with other devices.

Figure 19:
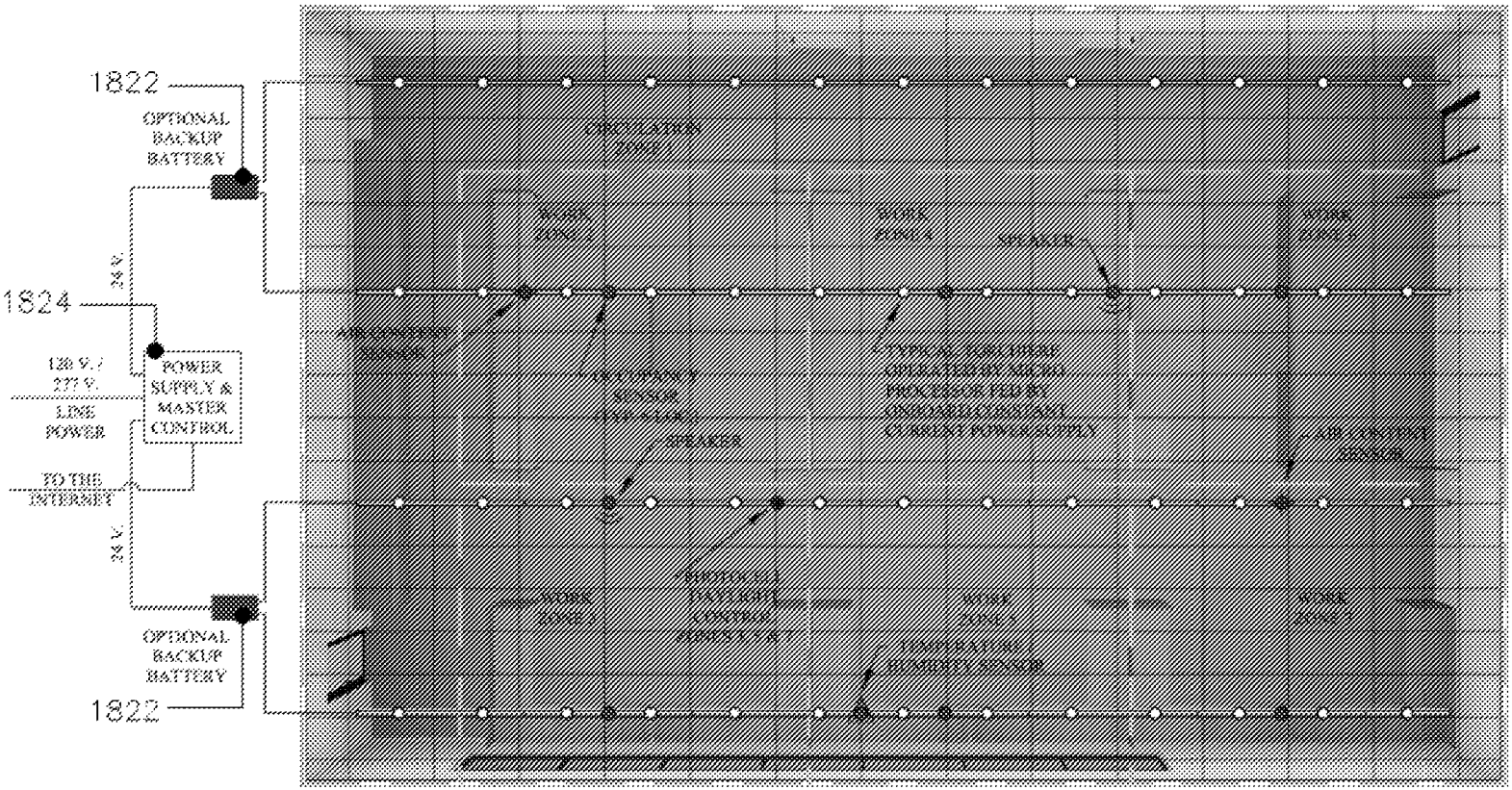
Figure 20A:
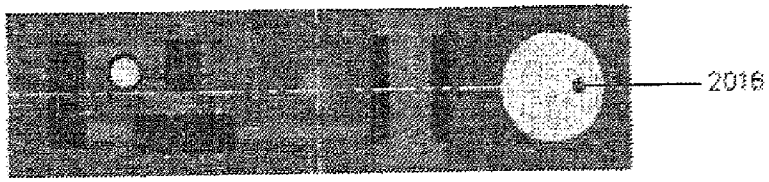
FIGS. 20A-D representatively illustrate a top view, side view, cross-sectional view, and bottom view of an adapter unit.
Figure 20C:
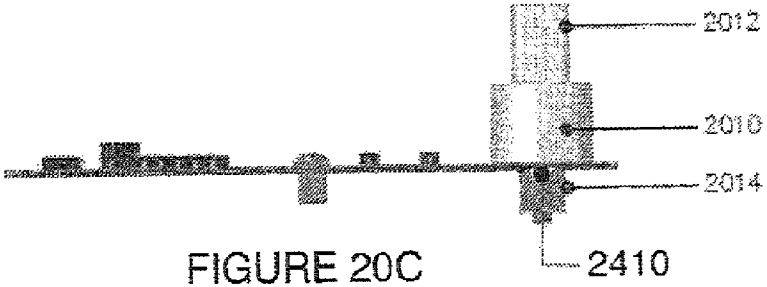
Figure 20D:
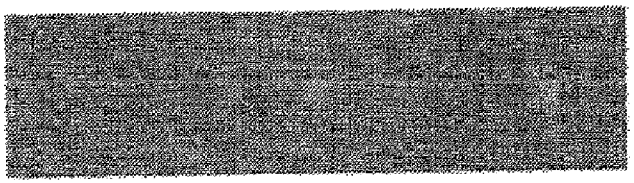
Figure 20B:
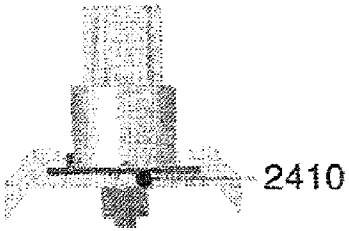
Figure 21B:
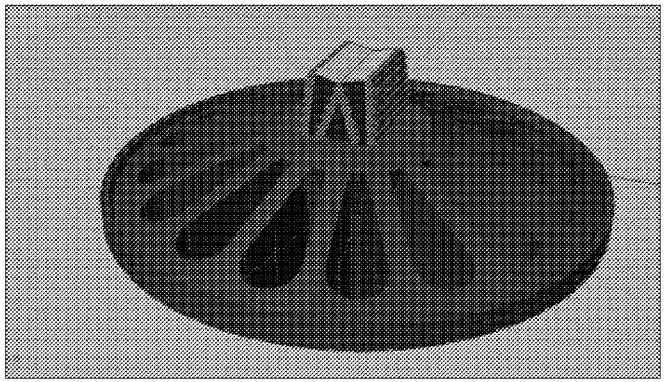
FIGS. 21A-D representatively illustrate a lens and an LED unit.
Figure 21D:
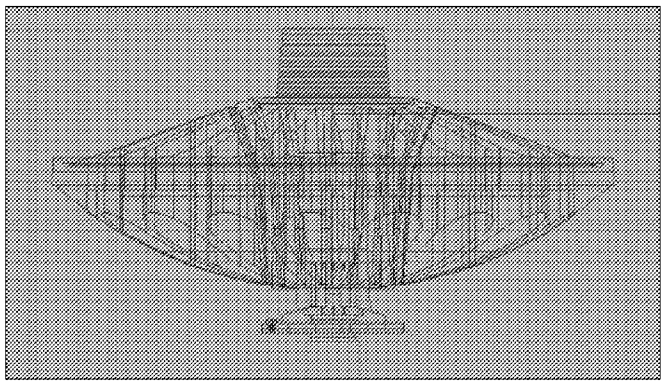
Figure 21A:
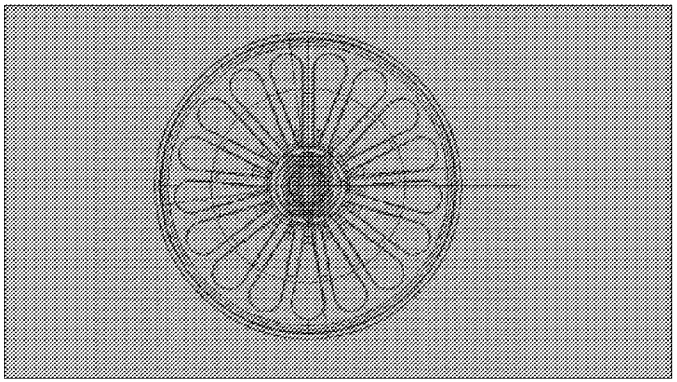
Figure 21C:
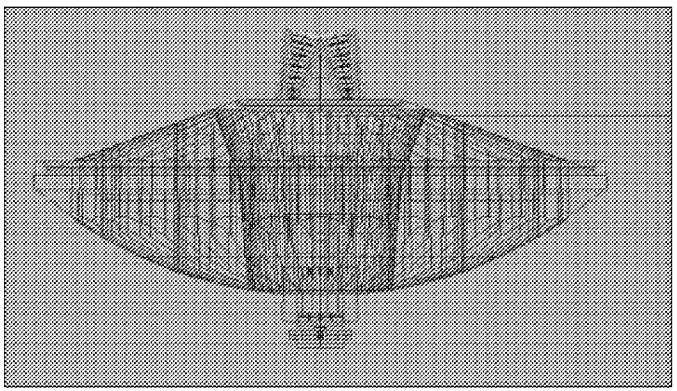

Referring to FIG. 18, in one embodiment, the control system may comprise a master control system 1824 connected to the wire way bars 145, such as via the command and control gateway. The master control system 1824 may operate independently of the power supply, or may control the power supply as well (FIG. 19). In the embodiment of FIG. 18, the devices are powered separately, and the devices are controlled through separate communication. Alternatively, the power supply may be combined into the master control, as depicted in FIG. 19. With the power supply integrated into the master controller, the master controller may control the devices by controlling the distribution of power to the various devices.

Referring again to FIG. 26, the control system 2600 may comprise any appropriate elements, such as a computer 2610, a network connection 2612, connections to the wires 120, such as connections to CCTV cameras and LED units 115, a power supply 2614, and a storage system 2616. These elements may be used by the control system 2600 to interact with external systems as well as the lighting system components, such as security systems, alarm systems, emergency responders, HVAC systems, or other suitable systems.

Various control functions may be implemented at the device level. For example, the LED lamp 105 may comprise control circuits. In some embodiments, the LED lamp 105 may be coupled to a power switch to open and/or close the circuit and/or coupled to a dimmer switch. In some embodiments, the LED lamp 105 may be coupled to a driver that may operate multiple circuits and LED lamps 105. The driver may be disposed in the LED unit 115, the adapter unit 140, in another device mounted in the lighting system such as a sensor, or in a remote location in relation to the lighting system 100, such as above the ceiling when the lighting system 100 is suspended from the ceiling.

In various embodiments, the control system 2600 may communicate with the power supply to control at least one condition of the LED 105, such as activating and deactivating the LED unit 115, and/or controlling its brightness, timing, or power consumption. The control system 2600 may also communicate information about movement from the occupancy sensor and light levels from the photocell sensor to the LED lamp 105. The control system 2600 may implement, however, any appropriate functions in conjunction with the devices in the system 100. For example, the control system 2600 may be implemented using a conventional power and control platform, such as a Redwood-Ready Redwood Platform from Redwood Systems, Inc.

Figure 17:
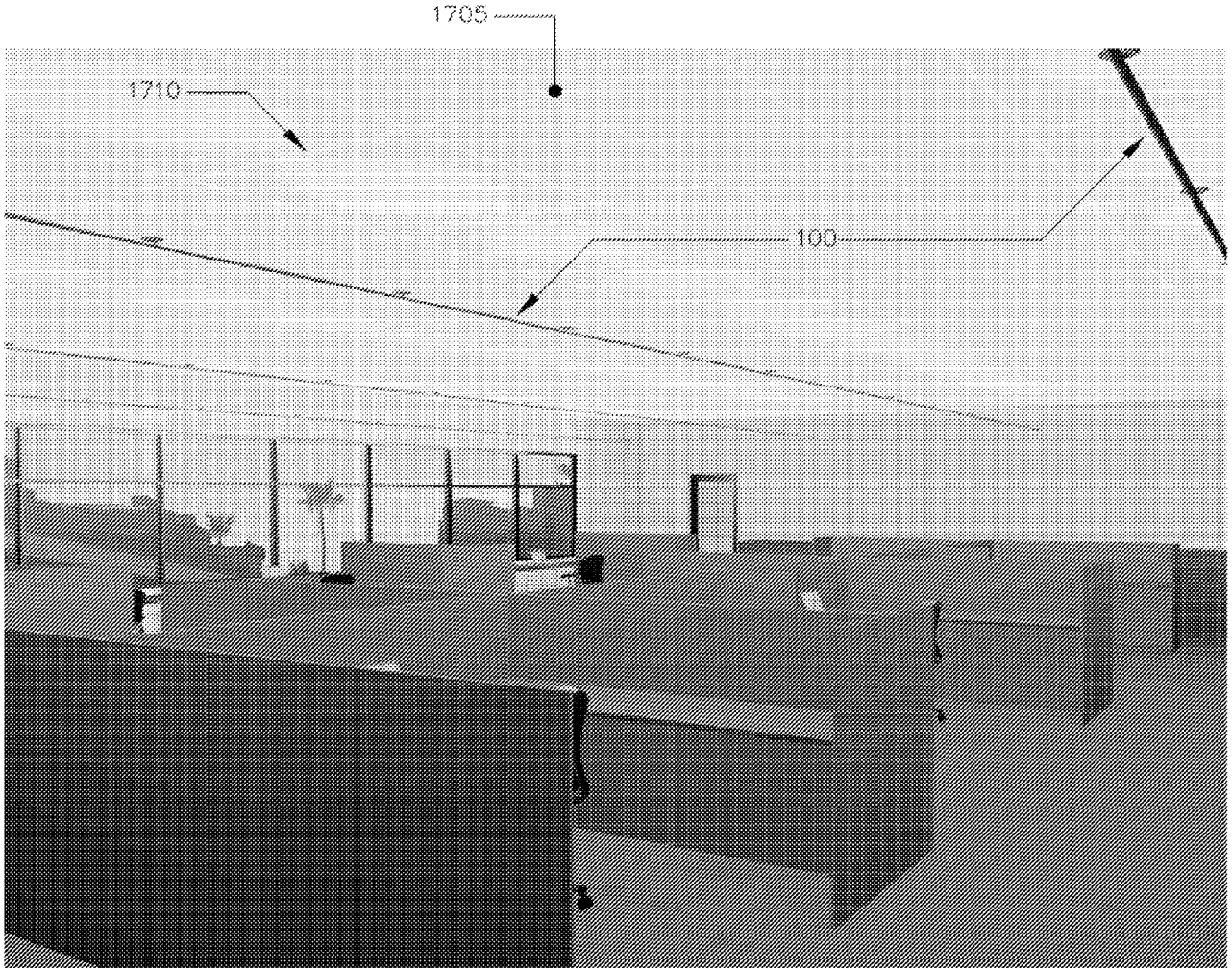
FIG. 17 representatively illustrates an interior view of a commercial space with a lighting system.

Referring to FIG. 17, in an exemplary embodiment, the lighting system 100 may be coupled to any surface, such as a wall or ceiling 1705, with any suitable connector and/or fastener system. For example, the lighting system 100 may be coupled to a ceiling using a wire, a metal rod, and/or a chain to suspend the lighting system 100 from a ceiling. The lighting system 100 may be coupled to the ceiling at any suitable distance to provide optimum light level conditions to the indoor space 1710. In one configuration, the lighting system 100 may be suspended within less than three feet from the ceiling 1705 which may maximize the reflection of the indirect light emanating from lighting system 100. This configuration of the LED lamp 105 may provide indirect lighting to the indoor space 1710 such as a commercial and/or institutional space.

In one embodiment, the lighting system 100 may interact with reflective ceiling tiles on the ceiling 1705 which may enhance the amount of light in the indoor space 1710. In another example, the lighting system 100 may be coupled to a wall using brackets, wires, and/or hooks.

Referring to FIG. 18, the lighting system 100 may be coupled to integral or ceiling-mounted environmental controls, such as an occupancy sensor 1810 and/or a photocell sensor switch 1805, in an indoor space 1815, such as a commercial and/or institutional space. The occupancy sensor 1810 may comprise any suitable monitoring device, such as a motion sensor, to activate the lighting system 100 when people are present and deactivate lighting system 100 when the room is empty, thus conserving energy. The photocell sensor switch 1805 may comprise any suitable sensor for controlling the lighting system 100 by detecting daylight levels. For example, the photocell sensor switch 1805 may activate and/or modulate the lighting system 100 when low daylight levels are detected.

The lighting system 100 may comprise a speaker 1835 that may be used to make announcements, sound alarms, or play music. The lighting system 100 may comprise an air quality sensor 1825 and a temperature/humidity sensor 1830, which may be used to check various environmental conditions. The control system 1824 may receive inputs from at least one of an occupancy sensor 1810, a photocell sensor 1805, an air content sensor 1825, and a temperature/humidity sensor 1830, and send a control signal to adjust a condition of the LED unit 115 or other system.

The lighting system 100 may be used in conjunction with reflective elements such as ceiling tiles to maximize efficient light diffusion to a work surface 415. For example, ceiling tiles may comprise a reflective material. In one embodiment, existing tile reflectance may provide increased reflectance for light diffusion. In another embodiment, the reflective material may be applied to and/or replace existing ceiling tiles. In one embodiment, the reflective elements may have greater than 50% reflectance. In another embodiment, the reflective elements may have greater than, or equal to, 90% reflectance. In another embodiment, the reflective elements may comprise a reflective cross sectional property such as an angle that may re-direct reflective light to the work surface in the shortest travel distance.

Figure 15:
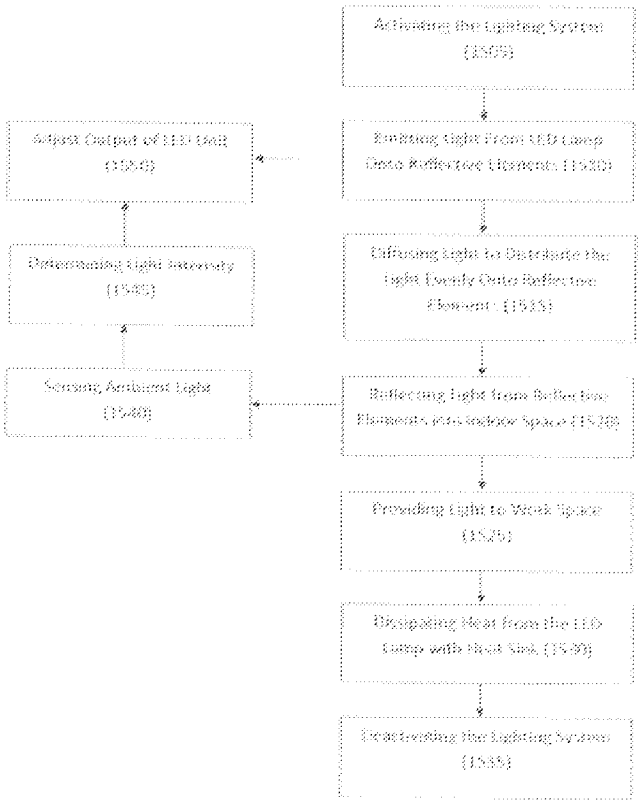
FIG. 15 is a flow chart illustrating an exemplary method of operating a ceiling suspended system in a commercial area.

FIG. 15 representatively illustrates an exemplary method of operation of a lighting system 100 according to various aspects of the present invention. The operation of the lighting system 100 may comprise activating the lighting system 100, such as by providing power (1505). Power may be provided to an LED lamp, such as the LED lamp 105, such as when an occupancy sensor coupled to the lighting system 100 detects the presence of people and/or a person turns a power switch on to open a LED power and/or control circuit. The LED lamp may then emit light onto the ceiling (1510). A diffuser coupled to the LED lamp, such as the diffuser 915, may diffuse the light emitted from the LED lamp substantially evenly onto the ceiling (1515). The light may be reflected from the ceiling down to an indoor space, such as the indoor space 1710, providing light to the work surface (1520, 1525).

In an optional embodiment, a sensor, such as the photocell 1305, may sense the level of ambient light in the indoor space (1540). The ambient light may comprise daylight entering the indoor space through a window. The sensor may determine the light intensity in the indoor space, and control the light emitted from the lighting system 100 to achieve the preselected light intensity (1545, 1550). For example, when daylight dims, the sensor may increase the light emitted from the LED lamp onto the ceiling. Further, heat generated from the LED lamp may be dissipated through the thermal conductivity of a thermal sink substrate, such as the heat sink 110, and/or a secondary cooling device such as a fan (1530). The lighting system 100 may then be deactivated by the occupancy sensor detecting an empty room and/or by a person closing the LED power and/or control circuit (1535).

Figure 16:
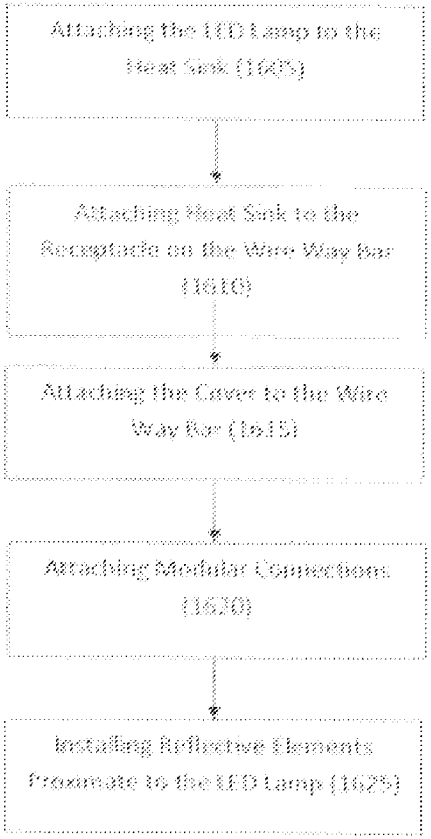
FIG. 16 is a flow chart illustrating a representative embodiment of a method of assembling a ceiling suspended system.

FIG. 16 representatively illustrates an exemplary method of manufacture or assembly according to various aspects of the present invention. The method of manufacture may comprise assembling an LED unit, such as the LED unit 115, by attaching an LED lamp, such as the LED lamp 105, to a thermal sink substrate, such as the heat sink 110 (1605). The LED unit and the thermal sink substrate may then be coupled to a receptacle, such as the receptacle 2010. The receptacle may be coupled to a wire way bar, such as the wire way bar 145 comprising a wire way channel, electrical wires, and/or a wire way cover. For example, the receptacle may be coupled to the electrical wires, such as the electrical wires 120, that may be under the wire way channel, such as the wire way channel 135 (1610). A wire way cover, such as the wire way cover 125, may be attached to the wire way channel to enclose electrical wires, such as the electrical wires 120 (1615).

The adapter unit 140 may comprise a power circuit, a control circuit, and/or a microprocessor 2005 for controlling the LED lamp. Mechanical and/or electrical modular connections may be attached to the controllable circuit, the microprocessor 2005, the wire way channel, and/or the wire way cover to connect multiple lighting systems 100 together (1620). In an optional method step, reflective ceiling tiles may be configured above and/or near the lighting system 100 to reflect the light emitted by the LED lamp down to the work surface 415 (1625).

In the foregoing description, the invention has been described with reference to specific exemplary embodiments. Various modifications and changes may be made, however, without departing from the scope of the present invention as set forth. The description and figures are to be regarded in an illustrative manner, rather than a restrictive one and all such modifications are intended to be included within the scope of the present invention. Accordingly, the scope of the invention should be determined by the generic embodiments described and their legal equivalents rather than by merely the specific examples described above. For example, the steps recited in any method or process embodiment may be executed in any appropriate order and are not limited to the explicit order presented in the specific examples. Additionally, the components and/or elements recited in any system embodiment may be combined in a variety of permutations to produce substantially the same result as the present invention and are accordingly not limited to the specific configuration recited in the specific examples.

Benefits, other advantages and solutions to problems have been described above with regard to particular embodiments. Any benefit, advantage, solution to problems or any element that may cause any particular benefit, advantage or solution to occur or to become more pronounced, however, is not to be construed as a critical, required or essential feature or component.

The terms "comprises", "comprising", or any variation thereof, are intended to reference a non-exclusive inclusion, such that a process, method, article, composition, system, or apparatus that comprises a list of elements does not include only those elements recited, but may also include other elements not expressly listed or inherent to such process, method, article, composition, system, or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

The present invention has been described above with reference to an exemplary embodiment. However, changes and modifications may be made to the exemplary embodiment without departing from the scope of the present invention. These and other changes or modifications are intended to be included within the scope of the present invention.

The invention claimed is:

1. An environmental control system for controlling a device unit in a structure, comprising:

a wire way bar defining an enclosed interior channel from a first end of the wire way bar to a second end of the wire way bar, wherein the enclosed interior channel comprises at least one port for coupling an adapter unit to the wire way bar; and at least one adapter unit coupled to the enclosed interior channel of the wire way bar in a fixed position, wherein the adapter unit comprises:

a microprocessor adapted to control the device unit; and a universal connector adapted to couple the device unit to the adapter unit.

2. The environmental control system according to claim 1, wherein:

the wire way bar is adapted to mount proximate to a reflective element; and the device unit comprises a light-emitting diode ("LED") unit adapted to emit a light toward the reflective element.

3. The environmental control system according to claim 2, wherein the LED unit comprises:

an LED lamp, wherein the LED lamp comprises:

an LED;

a thermally conductive substrate adapted to dissipate heat away from the LED to a heat sink;

a frame adapted to couple the thermally conductive substrate to the heat sink; and a diffuser covering the LED adapted to transmit the light emitted by the LED;

a heat sink coupled to the LED lamp and adapted to dissipate heat generated by the LED lamp, wherein the heat sink comprises a thermally conductive material; and a plurality of fins thermally coupled to and extending outward from the heat sink, wherein the plurality of fins is adapted to dissipate heat from the heat sink.

4. The environmental control system according to claim 2, wherein the LED unit further comprises a reflective lens, wherein the reflective lens comprises:

an input aperture;

a horizontal reflector adjacent to the input aperture;

an interior tent defined by planar parts and optically coupled above the aperture; and an exterior tent defined by planar parts and optically coupled outside the interior tent.

5. The environmental control system according to claim 4, wherein the reflective lens is disposed above the LED lamp and adapted to:

transmit a minimum of 94% of the light emitted by the LED lamp toward the reflective surface; and spread the emitted light from the LED lamp substantially uniformly across the reflective surface.

6. The environmental control system according to claim 1, wherein the wire way bar comprises:

a cover adapted to seal the enclosed interior channel; and at least one of an electrical wire and a communicative link extending through the interior channel from the first end of the wire way bar to the second end of the wire way bar and connecting to the at least one adapter unit.

7. The environmental control system according to claim 1, wherein the device unit comprises at least one of a light emitting diode ("LED") unit, a surveillance system, an audio system, a camera, a speaker, an antenna, and an environmental sensor comprising at least one of a photocell sensor, a smoke sensor, a humidity sensor, a motion sensor, and a thermal sensor.

8. The environmental control system according to claim 1, wherein the wire way bar further comprises a fastener on at leak one of the first end and second end, wherein the fastener is adapted to attach the wire way bar to a second wire way bar.

9. The environmental control system according to claim 1, further comprising at least one of an external power supply coupled to the wire way bar and a control system, wherein the control system comprises a master controller adapted to control distribution of power to the wire way bar.

10. The environmental control system according to claim 9, wherein the control system is adapted to communicate with at least one of the wire way bar and an external system.

11. The environmental control system according to claim 1, wherein the device unit is adapted to at least one of monitor, modify, and maintain the environment of the structure.

12. The environmental control system according to claim 1, wherein the adapter unit comprises at least one of a self-identifying chip and a pin-configured receptacle.

13. A lighting system, comprising:

a wire way bar, wherein the wire way bar comprises:

a frame defining an interior channel between a first end of the wire way bar and a second end of the wire way bar;

a cover coupled to the frame and adapted to seal the bottom portion of the interior channel to create an enclosed volume between the first end and the second end of the wire way bar;

a wire extending through the interior channel from the first end of the wire way bar to the second end of the wire way bar; and a plurality of ports disposed along a length of the frame, wherein each port provides an access to the wire;

a plurality of reflective elements adapted to be mounted at a preselected distance from the wire way bar;

a light-emitting diode ("LED") unit coupled to at least one of the plurality of ports in the wire way bar and located between the wire way bar and the reflective elements, wherein the LED unit is adapted to emit light toward the reflective elements; and an adapter unit coupled to the wire through the port in the wire way bar, wherein the adapter unit comprises a microprocessor adapted to control the LED unit.

14. A lighting system according to claim 13, wherein the LED unit comprises:

an LED lamp, wherein the LED lamp comprises:

an LED;

a thermally conductive substrate adapted to dissipate heat away from the LED to the heat sink;

a frame adapted to couple the thermally conductive substrate to the heat sink; and a diffuser covering the LED adapted to transmit the light emitted by the LED;

a heat sink coupled to the LED lamp and adapted to dissipate heat generated by the LED lamp, wherein the heat sink comprises a thermally conductive material; and a plurality of fins thermally coupled to and extending outward from the heat sink, wherein the plurality of fins is adapted to dissipate heat from the heat sink.

15. A lighting system according to claim 13, wherein the LED unit further comprises a reflective lens, wherein the reflective lens comprises:

an input aperture;

a horizontal reflector adjacent to the input aperture;

an interior tent defined by planar parts and optically coupled above the aperture; and an exterior tent defined by planar parts and optically coupled outside the interior tent.

16. A lighting system according to claim 15, wherein the reflective lens is disposed above the LED lamp and adapted to:

transmit a minimum of 94% of the light emitted by the LED lamp toward the reflective elements; and spread the emitted light from the LED lamp substantially uniformly across the reflective elements.

17. A lighting system according to claim 13, further comprising an environmental control system connected to a second adapter unit coupled to one of the plurality of ports, wherein:

the environmental control system is adapted to:

generate a signal in response to a detection of a condition in the environment; and transmit the signal to the second adapter unit;

the second adapter unit is adapted to communicate the signal to the first adapter unit; and the first adapter unit is adapted to adjust an output of the LED unit in response to the signal.

18. The environmental control system according to claim 13, wherein the device unit comprises at least one of a light emitting diode ("LED") unit, a surveillance system, an audio system, a camera, a speaker, an antenna, and an environmental sensor comprising at least one of a photocell sensor, a smoke sensor, a humidity sensor, a motion sensor, and a thermal sensor.

19. A method of indirectly lighting an area in conjunction with a plurality of reflective elements in a substantially planar configuration, comprising:

mounting a wire way bar proximate to the plurality of reflective elements at a preselected distance from the plurality of reflective elements, wherein the wire way bar comprises:

a frame defining an interior channel between a first end of the wire way bar and a second end of the wire way bar;

a cover coupled to the frame covering the interior channel to create an enclosed volume between the first end and second end of the wire way bar;

a wire extending through the interior channel from the first end of the wire way bar to the second end of the wire way bar; and a plurality of ports disposed along a length of the wire way bar, wherein each port provides an access point to the interior channel;

coupling a light-emitting diode ("LED") unit to a first port in the plurality of ports, wherein the LED unit is adapted to emit a light toward the plurality of reflective elements; and coupling a first adapter unit between the LED unit and the first port, wherein the first adapter unit is adapted to control the LED unit.

20. A method of indirectly lighting an area according to claim 19, further comprising:

coupling a second adapter unit to a second port in the plurality of ports; and coupling an environmental control system to the second adapter unit, wherein:

the second adapter unit is adapted to control the environmental control system; and the environmental control system is adapted to generate a signal in response to sensing an event in the environment, wherein the signal is communicated from the second adapter unit to the first adapter unit to cause an output of the LED unit to be adjusted in response to the signal.

* * * * *